US008439116B2

(12) United States Patent
East, Jr. et al.

(10) Patent No.: US 8,439,116 B2
(45) Date of Patent: May 14, 2013

(54) METHOD FOR INDUCING FRACTURE COMPLEXITY IN HYDRAULICALLY FRACTURED HORIZONTAL WELL COMPLETIONS

(75) Inventors: Loyd E. East, Jr., Tomball, TX (US); Mohamed Y. Soliman, Cypress, TX (US); Jody R. Augustine, League City, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 86 days.

(21) Appl. No.: 12/566,467

(22) Filed: Sep. 24, 2009

(65) Prior Publication Data

US 2011/0017458 A1 Jan. 27, 2011

Related U.S. Application Data

(60) Provisional application No. 61/228,494, filed on Jul. 24, 2009, provisional application No. 61/243,453, filed on Sep. 17, 2009.

(51) Int. Cl.
*E21B 43/26* (2006.01)

(52) U.S. Cl.
USPC ..... 166/308.1; 166/250.1

(58) Field of Classification Search ..... 166/308.1, 166/177.5, 334.4, 250.1
See application file for complete search history.

(56) References Cited

U.S. PATENT DOCUMENTS

| | | | |
|---|---|---|---|
| 2,312,018 | A | 2/1943 | Beckman |
| 2,703,316 | A | 3/1955 | Schneider |
| 2,753,940 | A | 7/1956 | Bonner |
| 3,912,692 | A | 10/1975 | Casey et al. |
| 4,005,750 | A | 2/1977 | Shuck |
| 4,312,406 | A | 1/1982 | McLaurin et al. |
| 4,387,769 | A | 6/1983 | Erbstoesser et al. |
| 4,509,598 | A | 4/1985 | Earl et al. |

(Continued)

FOREIGN PATENT DOCUMENTS

| | | | |
|---|---|---|---|
| CA | 2734351 | A1 | 2/2010 |
| WO | 03072907 | A1 | 9/2003 |

(Continued)

OTHER PUBLICATIONS

Baski brochure entitled, "Packers: general information," http://www.baski.com/packer.htm, Dec. 16, 2009, 4 pages, Baski, Inc.

(Continued)

*Primary Examiner* — David Andrews
(74) *Attorney, Agent, or Firm* — Robert Kent; Conley Rose, P.C.

(57) ABSTRACT

A method of inducing fracture complexity within a fracturing interval of a subterranean formation comprising characterizing the subterranean formation, defining a stress anisotropy-altering dimension, providing a wellbore servicing apparatus configured to alter the stress anisotropy of the fracturing interval of the subterranean formation, altering the stress anisotropy within the fracturing interval, and introducing a fracture in the fracturing interval in which the stress anisotropy has been altered. A method of servicing a subterranean formation comprising introducing a fracture into a first fracturing interval, and introducing a fracture into a third fracturing interval, wherein the first fracturing interval and the third fracturing interval are substantially adjacent to a second fracturing interval in which the stress anisotropy is to be altered.

32 Claims, 19 Drawing Sheets

U.S. PATENT DOCUMENTS 4,515,214 A 5/1985 Fitch et al.
4,590,995 A 5/1986 Evans
4,687,061 A 8/1987 Uhri
4,869,322 A 9/1989 Vogt, Jr. et al.
4,887,670 A 12/1989 Lord et al.
5,074,360 A 12/1991 Guinn
5,111,881 A 5/1992 Soliman et al.
5,216,050 A 6/1993 Sinclair
5,241,475 A 8/1993 Lee et al.
5,318,123 A 6/1994 Venditto et al.
5,482,116 A 1/1996 El-Rabaa et al.
5,494,103 A 2/1996 Surjaatmadja et al.
5,499,678 A 3/1996 Surjaatmadja et al.
5,533,571 A 7/1996 Surjaatmadja et al.
5,547,023 A 8/1996 McDaniel et al.
5,595,245 A 1/1997 Scott, III
5,765,642 A 6/1998 Surjaatmadja
6,047,773 A 4/2000 Zeltmann et al.
6,283,210 B1 9/2001 Soliman et al.
6,323,307 B1 11/2001 Bigg et al.
6,394,184 B2 5/2002 Tolman et al.
6,401,815 B1 6/2002 Surjaatmadja et al.
6,439,310 B1 8/2002 Scott, III et al.
6,474,419 B2 11/2002 Maier et al.
6,543,538 B2 4/2003 Tolman et al.
6,565,129 B2 5/2003 Surjaatmadja
6,662,874 B2 12/2003 Surjaatmadja et al.
6,719,054 B2 4/2004 Cheng et al.
6,725,933 B2 4/2004 Middaugh et al.
6,779,607 B2 8/2004 Middaugh et al.
6,805,199 B2 10/2004 Surjaatmadja
6,837,523 B2 1/2005 Surjaatmadja et al.
6,907,936 B2 6/2005 Fehr et al.
6,938,690 B2 9/2005 Surjaatmadja
7,032,671 B2 * 4/2006 Aud ..... 166/308.1
7,044,220 B2 5/2006 Nguyen et al.
7,059,407 B2 6/2006 Tolman et al.
7,066,265 B2 6/2006 Surjaatmadja
7,090,153 B2 8/2006 King et al.
7,096,954 B2 8/2006 Weng et al.
7,100,688 B2 9/2006 Stephenson et al.
7,108,064 B2 9/2006 Hart et al.
7,108,067 B2 9/2006 Themig et al.
7,150,327 B2 12/2006 Surjaatmadja
7,159,660 B2 1/2007 Justus
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,273,099 B2 9/2007 East, Jr. et al.
7,273,313 B2 9/2007 Surjaatmadja
7,281,581 B2 10/2007 Nguyen et al.
7,287,592 B2 10/2007 Surjaatmadja et al.
7,296,625 B2 11/2007 East, Jr.
7,318,473 B2 1/2008 East, Jr. et al.
7,322,417 B2 1/2008 Rytlewski et al.
7,325,608 B2 2/2008 van Batenburg et al.
7,337,844 B2 3/2008 Surjaatmadja et al.
7,343,975 B2 3/2008 Surjaatmadja et al.
7,370,701 B2 5/2008 Surjaatmadja et al.
7,387,165 B2 6/2008 Lopez de Cardenas et al.
7,398,825 B2 7/2008 Nguyen et al.
7,429,332 B2 9/2008 Surjaatmadja et al.
7,431,090 B2 10/2008 Surjaatmadja et al.
7,445,045 B2 11/2008 East, Jr. et al.
7,472,746 B2 1/2009 Maier
7,478,020 B2 1/2009 Guo et al.
7,478,676 B2 1/2009 East, Jr. et al.
7,503,404 B2 3/2009 McDaniel et al.
7,506,689 B2 3/2009 Surjaatmadja et al.
7,520,327 B2 4/2009 Surjaatmadja
7,543,635 B2 6/2009 East et al.
7,571,766 B2 8/2009 Pauls et al.
7,571,767 B2 8/2009 Parker et al.
7,575,062 B2 8/2009 East, Jr.
7,580,796 B2 8/2009 Soliman et al.
7,595,281 B2 9/2009 McDaniel et al.
7,610,959 B2 11/2009 Surjaatmadja
7,617,871 B2 11/2009 Surjaatmadja et al.
7,625,846 B2 12/2009 Cooke, Jr.
7,647,964 B2 1/2010 Akbar et al.
7,673,673 B2 3/2010 Surjaatmadja et al.
7,681,645 B2 3/2010 McMillin et al.
7,690,427 B2 4/2010 Rispler
7,703,510 B2 4/2010 Xu
7,711,487 B2 5/2010 Surjaatmadja
7,723,264 B2 5/2010 McDaniel et al.
7,726,403 B2 6/2010 Surjaatmadja
7,730,951 B2 6/2010 Surjaatmadja et al.
7,740,072 B2 6/2010 Surjaatmadja
7,766,083 B2 8/2010 Willett et al.
7,775,278 B2 8/2010 Willberg et al.
7,841,396 B2 11/2010 Surjaatmadja
7,849,924 B2 12/2010 Surjaatmadja et al.
7,874,365 B2 1/2011 East, Jr. et al.
7,882,894 B2 2/2011 Nguyen et al.
7,931,082 B2 4/2011 Surjaatmadja
7,946,340 B2 5/2011 Surjaatmadja et al.
7,963,331 B2 6/2011 Surjaatmadja et al.
8,016,032 B2 9/2011 Mandrell et al.
8,056,638 B2 11/2011 Clayton et al.
8,061,426 B2 11/2011 Surjaatmadja
8,066,068 B2 11/2011 Lesko et al.
8,074,715 B2 12/2011 Rispler et al.
8,096,358 B2 1/2012 Rispler et al.
8,104,535 B2 1/2012 Sierra et al.
8,104,539 B2 1/2012 Stanojcic et al.
8,210,257 B2 7/2012 Dusterhoft et al.
8,267,172 B2 9/2012 Surjaatmadja et al.
8,307,893 B2 11/2012 Sierra et al.
8,307,904 B2 11/2012 Surjaatmadja
2005/0125209 A1 6/2005 Soliman et al.
2006/0070740 A1 4/2006 Surjaatmadja et al.
2006/0086507 A1 4/2006 Surjaatmadja et al.
2007/0102156 A1 5/2007 Nguyen et al.
2007/0261851 A1 11/2007 Surjaatmadja
2007/0284106 A1 12/2007 Kalman et al.
2007/0295506 A1 12/2007 Li et al.
2008/0000637 A1 1/2008 McDaniel et al.
2008/0060810 A9 3/2008 Nguyen et al.
2008/0135248 A1 6/2008 Talley et al.
2008/0217021 A1 9/2008 Lembcke et al.
2008/0302538 A1 12/2008 Hofman
2009/0014168 A1 1/2009 Tips et al.
2009/0062157 A1 3/2009 Munoz, Jr. et al.
2009/0118083 A1 5/2009 Kaminsky et al.
2009/0125280 A1 5/2009 Soliman et al.
2009/0288833 A1 11/2009 Graham et al.
2009/0308588 A1 12/2009 Howell et al.
2010/0000727 A1 1/2010 Webb et al.
2010/0044041 A1 2/2010 Smith et al.
2010/0243253 A1 9/2010 Surjaatmadja et al.
2011/0028358 A1 2/2011 Welton et al.
2011/0284214 A1 11/2011 Ayoub et al.
2012/0118568 A1 5/2012 Kleefisch et al.

FOREIGN PATENT DOCUMENTS

WO 2008027982 A2 3/2008
WO 2010020747 A2 2/2010
WO 2010020747 A3 2/2010
WO 2011010113 A2 1/2011
WO 2011010113 A3 1/2011

OTHER PUBLICATIONS

Cipolla, C. L., et al., "The relationship between fracture complexity, reservoir properties, and fracture treatment design," SPE 115769, 2008, pp. 1-25, Society of Petroleum Engineers.
Halliburton brochure entitled "Cobra Frac® service," Oct. 2004, 2 pages, Halliburton.
Halliburton brochure entitled "Cobra Frac® H service," Mar. 2009, 2 pages, Halliburton.
Halliburton brochure entitled "Cobra Frac® H service," Sep. 2009, 2 pages, Halliburton.
Halliburton brochure entitled "Delta Stim™ sleeve," Mar. 2007, 2 pages, Halliburton.

Halliburton brochure entitled "EquiFlow™ inflow control devices," Jan. 2008, 2 pages, Halliburton.
Halliburton brochure entitled, "RDT™—oval pad and straddle packer," Feb. 2008, 2 pages. Halliburton.
Halliburton brochure entitled, "Swellpacker™cable system," 2009, 2 pages, Halliburton.
Halliburton HT-400 pump maintenance and repair manual, Jun. 1997, pp. 1-14, 1-15, 5-12 to 5-15, and 7-106 to 7-109, Halliburton.
Kundert, Donald, et al., "Proper evaluation of shale gas reservoirs leads to a more effective hydraulic-fracture stimulation," SPE 123586, 2009, pp. 1-11, Society of Petroleum Engineers.
Mullen, Mike, et al., A composite determination of mechanical rock properties for stimulation design (what to do when you don't have a sonic log), SPE 108139, 2007, pp. 1-13, Society of Petroleum Engineers.
Norris, M. R., et al., "Multiple proppant fracturing of horizontal wellbores in a chalk formation: evolving the process in the Valhall Field," SPE 50608, 1998, pp. 335-349, Society of Petroleum Engineers, Inc.
Office Action dated Apr. 28, 2010 (22 pages), U.S. Appl. No. 12/358,079, filed Jan. 22, 2009.
Patent application entitled "Apparatus and method for servicing a wellbore," by Jim B. Surjaatmadja, et al., filed Nov. 19, 2008 as U.S. Appl. No. 12/274,193.
Patent application entitled "Complex fracturing using a straddle packer in a horizontal wellbore," by Loyd E. East, Jr., filed Jan. 12, 2010 as U.S. Appl. No. 12/686,116.
Provisional patent application entitled "High rate stimulation method for deep, large bore completions," by Malcolm Joseph Smith, et al., filed Aug. 22, 2008 as U.S. Appl. No. 61/091,229.
Provisional patent application entitled "Method for inducing fracture complexity in hydraulically fractured horizontal well completions," by Loyd E. East, Jr., et al., filed Jul. 24, 2009 as U.S. Appl. No. 61/228,494.
Provisional patent application entitled "Method for inducing fracture complexity in hydraulically fractured horizontal well completions," by Loyd E. East, Jr., et al., filed Sep. 17, 2009 as U.S. Appl. No. 61/243,453.
Ramurthy, Muthukumarappan, et al., "Effects of high-pressure-dependent leakoff and high-process-zone stress in coal stimulation treatments," SPE 107971, 2007, pp. 1-8, Society of Petroleum Engineers.
Rickman, Rick, et al., "A practical use of shale petrophysics for stimulation design optimization: all shale plays are not clones of the Barnett Shale," SPE 115258, 2008, pp. 1-11, Society of Petroleum Engineers.
Sneddon, I. N., "The distribution of stress in the neighbourhood of a crack in an elastic solid," Proceedings of the Royal Society of London; Series A, Mathematical and Physical Sciences, Oct. 22, 1946, pp. 229-260, vol. 187, No. 1009, The Royal Society.
Sneddon, I. N., et al., "The opening of a Griffith crack under internal pressure," 1946, p. 262-267, vol. 4, No. 3, Quarterly of Applied Mathematics.
Soliman, M. Y., et al., "Effect of friction and leak-off on fracture parameters calculated from hydraulic impedance testing," SPE 39529, 1998, pp. 245-251, Society of Petroleum Engineers, Inc.
Soliman, M. Y., et al., "GeoMechanics aspects of multiple fracturing of horizontal and vertical wells," SPE 86992, 2004, pp. 1-15, Society of Petroleum Engineers Inc.
Soliman, M. Y., et al., "Geomechanics aspects of multiple fracturing of horizontal and vertical wells," SPE 86992, SPE Drilling and Completion, Sep. 2008, pp. 217-228, Society of Petroleum Engineers.
Waters, George, et al., "Simultaneous hydraulic fracturing of adjacent horizontal wells in the Woodford Shale," SPE 119635, 2009, pp. 1-22, Society of Petroleum Engineers.
Foreign communication from a related counterpart application—International Search Report and Written Opinion, PCT/GB2009/001904, Apr. 13, 2011, 10 pages.
Office Action dated Apr. 4, 2011 (12 pages), U.S. Appl. No. 12/358,079, filed Jan. 22, 2009.
Office Action dated Oct. 8, 2010 (17 pages), U.S. Appl. No. 12/358,079, filed Jan. 22, 2009.
Office Action dated Oct. 19, 2011 (12 pages), U.S. Appl. No. 12/358,079, filed Jan. 22, 2009.
Foreign communication from a related counterpart application—International Preliminary Report on Patentability, PCT/GB2010/001407, Jan. 24, 2012, 8 pages.
Office Action dated May 23, 2012 (43 pages), U.S. Appl. No. 12/686,116, filed Jan. 12, 2010.
Foreign communication from a related counterpart application—Canadian Office Action, CA 2,734,351, Jun. 19, 2012, 2 pages.
Advisory Action dated Dec. 7, 2011 (2 pages), U.S. Appl. No. 12/358,079, filed Jan. 22, 2009.
Patent application entitled "Method of Inducing Fracture Complexity in Hydraulically Fractured Horizontal Well Completions," by Loyd E. East, Jr., filed Feb. 23, 2012 as U.S. Appl. No. 13/403,423.
Advances in Polymer Science, Author Index vols. 101-157 and Subject Index, 2002, 17 pages, Springer-Verlag Berlin Heidelberg.
Advances in Polymer Science, vol. 157, "Degradable Aliphatic Polyesters,"2002, 10 pages of Content and Publishing Information, Springer-Verlag Berlin Heidelberg.
Albertsson, Ann-Christine, et al., "Aliphatic Polyesters: Synthesis, Properties and Applications," Chapter 1 of Advances in Polymer Science, 2002, pp. 1-40, vol. 157, Springer-Verlag Berlin Heidelberg.
Edlund, U., et al., "Degradable Polymer Microspheres for Controlled Drug Delivery," Chapter 3 of Advances in Polymer Science, 2002, pp. 67-112, vol. 157, Springer-Verlag Berlin Heidelberg.
Hakkarainen, Minna, "Aliphatic Polyesters: Abiotic and Biotic Degradation and Degradation Products," Chapter 4 of Advances in Polymer Science, 2002, pp. 113-138, vol. 157, Springer-Verlag Berlin Heidelberg.
Halliburton brochure entitled "CobraMax® DM Service," Jul. 2011, 2 pages, Halliburton.
Lindsay, S. et al., "Downhole Mixing Fracturing Method Using Coiled Tubing Efficiently: Executed in the Eagle Ford Shale," SPE 153312, 2012, pp. 1-14, Society of Petroleum Engineers.
Lindblad, Margaretha Söderqvist, et al., "Polymers from Renewable Resources" Chapter 5 of Advances in Polymer Science, 2002, pp. 139-161, vol. 157, Springer-Verlag Berlin Heidelberg.
Office Action (Final) dated Oct. 29, 2012 (17 pages), U.S. Appl. No. 12/686,116, filed Jan. 12, 2010.
Advisory Action dated Jan. 2, 2013 (4 pages), U.S. Appl. No. 12/686,116, filed Jan. 12, 2010. (1391-89600).
Filing receipt and patent application entitled "Method and Wellbore Servicing Apparatus for Production Completion of an Oil and Gas Well," by Jim B. Surjaatmadja, et al., filed Aug. 6, 2012 as U.S. Appl. No. 13/567,953.
Filing receipt and patent application entitled "Multi-Interval Wellbore Treatment Method," by Loyd Eddie East, et al., filed Apr. 9, 2012 as U.S. Appl. No. 13/442,441.
Stridsberg, Kajsa M., et al., "Controlled Ring-Opening Polymerization: Polymers with designed Macromolecular Architecture," Chapter 2 of Advances in Polymer Science, 2002, pp. 41-65, vol. 157, Springer-Verlag Berlin Heidelberg.
Warpinski, N.R., et al., "Mapping hydraulic fracture growth and geometry using microseismic events detected by a wireline retrievable accelerometer array," SPE 40014, 1998, pp. 335-346, Society of Petroleum Engineers.
Foreign communication from a related counterpart application—International Preliminary Report on Patentability, PCT/GB2009/001904, Apr. 19, 2011, 7 pages.
Foreign communication from a related counterpart application—International Search Report and Written Opinion, PCT/GB2010/001407, Mar. 23, 2011, 10 pages.

* cited by examiner

METHOD FOR INDUCING FRACTURE COMPLEXITY IN HYDRAULICALLY FRACTURED HORIZONTAL WELL COMPLETIONS

CROSS-REFERENCE TO RELATED APPLICATIONS

The present application claims priority to U.S. Provisional Patent Application Ser. No. 61/228,494 filed Jul. 24, 2009 by East et al. and entitled "Method for Inducing Fracture Complexity in Hydraulically Fractured Horizontal Well Completions" and to U.S. Provisional Patent Application Ser. No. 61/243,453 filed Sep. 17, 2009 by East et al. and entitled "Method for Inducing Fracture Complexity in Hydraulically Fractured Horizontal Well Completions," each of which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a fracturing fluid may be introduced into a portion of a subterranean formation penetrated by a wellbore at a hydraulic pressure sufficient to create or enhance at least one fracture therein. Stimulating or treating the wellbore in such ways increases hydrocarbon production from the well. Fractures are formed when a subterranean formation is stressed or strained.

In some instances, where multiple fractures are propagated, those fractures may form an interconnected network of fractures referred to herein as a "fracture network." In some instances, fracture networks may contribute to the fluid flow rates (permeability or transmissability) through formations and, as such, improve the recovery of hydrocarbons from a subterranean formation. Fracture networks may vary in degree as to complexity and branching.

Fracture networks may comprise induced fractures introduced into a subterranean formation, fractures naturally occurring in a subterranean formation, or combinations thereof. Heterogeneous subterranean formations may comprise natural fractures which may or may not be conductive under original state conditions. As a fracture is introduced into a subterranean formation, for example, as by a hydraulic fracturing operation, natural fractures may be altered from their original state. For example, natural fractures may dilate, constrict, or otherwise shift. Where natural fractures are dilated as a result of a fracturing operation, the induced fractures and dilated natural fractures may form a fracture network, as opposed to bi-wing fractures which are conventionally associated with fracturing operations. Such a fracture network may result in greater connectivity to the reservoirs, allowing more pathways to produce hydrocarbons.

Some subterranean formations may exhibit stress conditions such that a fracture introduced into that subterranean formation is discouraged or prevented from extending in multiple directions (e.g., so as to form a branched fracture) or such that sufficient dilation of the natural fractures is discouraged or prevented, thereby discouraging the creation of complex fracture networks. As such, the creation of fracture networks is often limited by conventional fracturing methods. Thus, there is a need for an improved method of creating branched fractures and fractures networks.

SUMMARY

Disclosed herein is a method of inducing fracture complexity within a fracturing interval of a subterranean formation comprising characterizing the subterranean formation, defining a stress anisotropy-altering dimension, providing a wellbore servicing apparatus configured to alter the stress anisotropy of the fracturing interval of the subterranean formation, altering the stress anisotropy within the fracturing interval, and introducing a fracture in the fracturing interval in which the stress anisotropy has been altered.

Also disclosed herein is a method of servicing a subterranean formation comprising introducing a fracture into a first fracturing interval, and introducing a fracture into a third fracturing interval, wherein the first fracturing interval and the third fracturing interval are substantially adjacent to a second fracturing interval in which the stress anisotropy is to be altered.

Further disclosed herein is a method of servicing a wellbore comprising introducing a fracture into a first fracturing interval, introducing a fracture into a third fracturing interval, introducing a fracture into a second fracturing interval, wherein the second fracturing interval is between the first fracturing interval and the third fracturing interval, and wherein the fracture introduced into the second fracturing interval is introduced after the fractures are introduced into the first fracturing interval and the third fracturing interval.

Further disclosed herein is a method of servicing a wellbore comprising introducing a fracture into a first fracturing interval, introducing a fracture into a third fracturing interval, introducing a fracture into a second fracturing interval, wherein the second fracturing interval is between the first fracturing interval and the third fracturing interval, and wherein the fracture introduced into the second fracturing interval is introduced after the fractures are introduced into the first fracturing interval and the third fracturing interval.

DETAILED DESCRIPTION OF THE EMBODIMENTS

Figure 1:
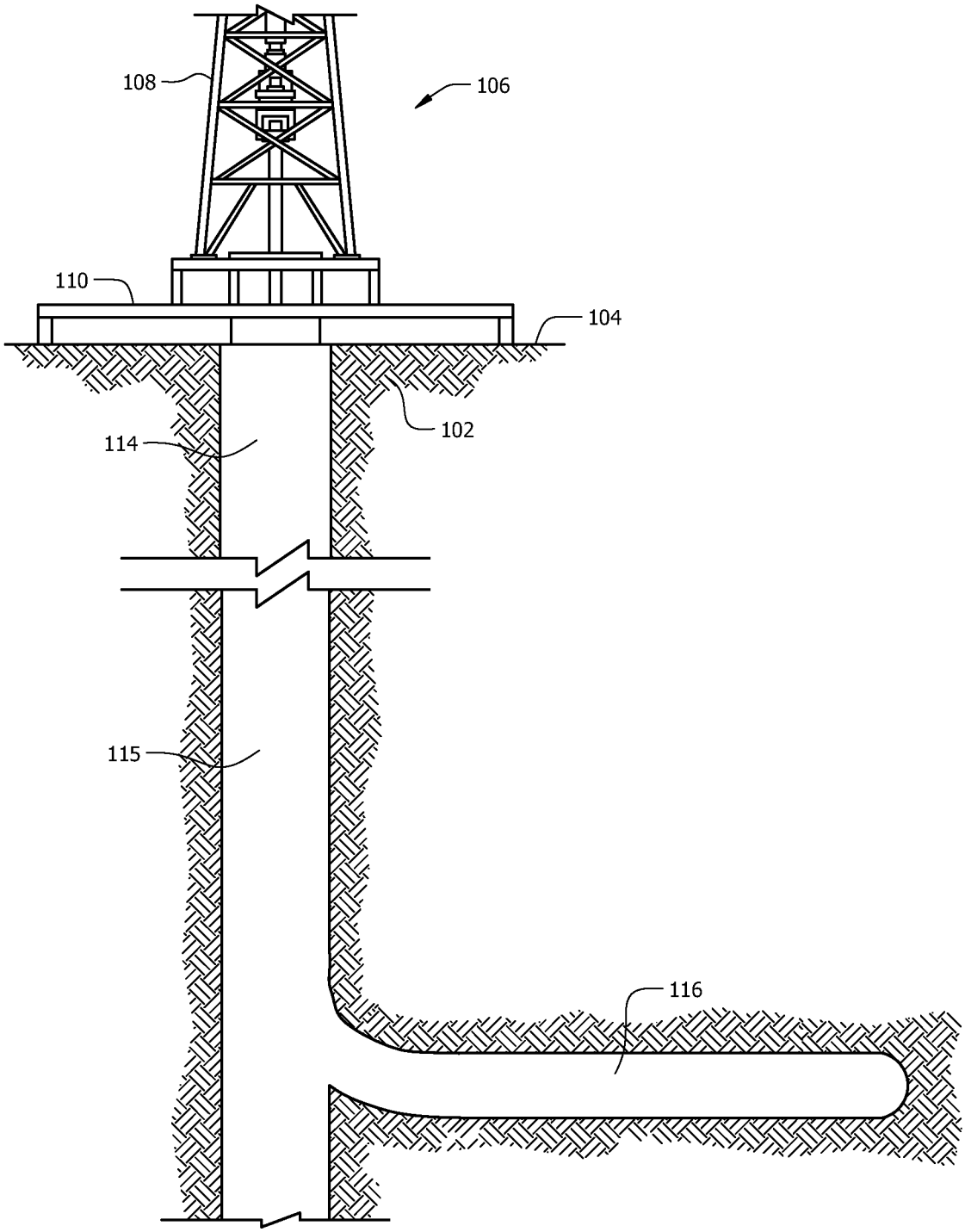
FIG. 1 is a partial cutaway view of a wellbore penetrating a subterranean formation.

In the drawings and descriptions that follow, like parts are typically marked throughout the specification and drawings with the same reference numerals, respectively. The drawn figures are not necessarily to scale. Certain features of the invention may be shown exaggerated in scale or in somewhat schematic form and some details of conventional elements may not be shown in the interest of clarity and conciseness. The present invention may be implemented in embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Referring to FIG. 1, an exemplary operating environment of an embodiment of the methods, systems, and apparatuses disclosed herein is depicted. Unless otherwise stated, the horizontal, vertical, or deviated nature of any figure is not to be construed as limiting the wellbore to any particular configuration. As depicted, the operating environment may suitably comprise a drilling rig 106 positioned on the earth's surface 104 and extending over and around a wellbore 114 penetrating a subterranean formation 102 for the purpose of recovering hydrocarbons. The wellbore 114 may be drilled into the subterranean formation 102 using any suitable drilling technique. In an embodiment, the drilling rig 106 comprises a derrick 108 with a rig floor 110. The drilling rig 106 may be conventional and may comprise a motor driven winch and/or other associated equipment for extending a work string, a casing string, or both into the wellbore 114.

In an embodiment, the wellbore 114 may extend substantially vertically away from the earth's surface 104 over a vertical wellbore portion 115, or may deviate at any angle from the earth's surface 104 over a deviated or horizontal wellbore portion 116. In an embodiment, a wellbore like wellbore 114 may comprise one or more deviated or horizontal wellbore portions 116. In alternative operating environments, portions or substantially all of the wellbore 114 may be vertical, deviated, horizontal, and/or curved.

While the operating environment depicted in FIG. 1 refers to a stationary drilling rig 106, one of ordinary skill in the art will readily appreciate that mobile workover rigs, wellbore servicing units (e.g., coiled tubing units), and the like may be similarly employed. Further, while the exemplary operating environment depicted in FIG. 1 refers to a wellbore penetrating the earth's surface on dry land, it should be understood that one or more of the methods, systems, and apparatuses illustrated herein may alternatively be employed in other operational environments, such as within an offshore wellbore operational environment for example, a wellbore penetrating subterranean formation beneath a body of water.

Figure 2:
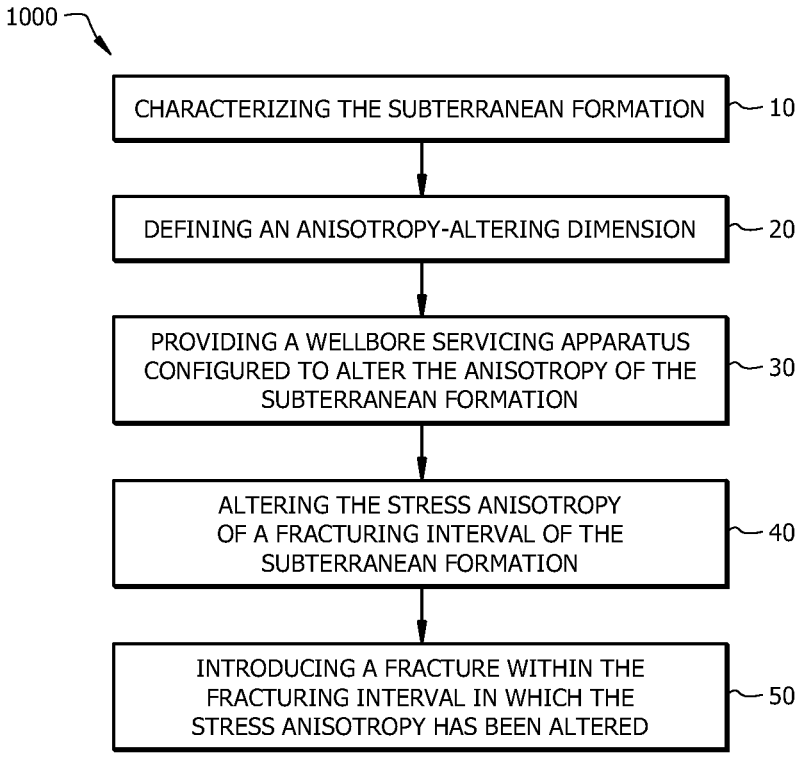
FIG. 2 is a diagram of a method of inducing fracture complexity within a subterranean formation.

Disclosed herein are one or more methods, systems, or apparatuses suitably employed for inducing fracture complexity into a subterranean formation. As used herein, references to inducing fracture complexity into a subterranean formation include the creation of branched fractures, fracture networks, and the like. Referring to FIG. 2, an embodiment of a method suitably employed to induce fracture complexity into a subterranean formation, referred to herein as a fracture complexity inducing method (FCI) 1000, is illustrated graphically. In an embodiment, the FCI 1000 generally comprises characterizing the subterranean formation 10, determining an anisotropy-altering dimension 20, providing a wellbore servicing apparatus configured to allow alteration of the anisotropy of the subterranean formation 30 by a fracturing treatment, altering the stress anisotropy of a fracturing interval of the subterranean formation 40, introducing a fracture into the subterranean formation in which the stress anisotropy has been altered 50. As will be discussed with reference to FIG. 3, an embodiment of the forgoing step of determining an anisotropy-altering dimension 20 will be discussed in greater detail. As will be discussed with reference to FIG. 4, an embodiment of the forgoing step of altering the stress anisotropy of a fracturing interval of the subterranean formation 40 will be discussed in greater detail. As used herein, the phrase "fracturing interval" refers to a portion of a subterranean formation into which a fracture may be introduced and/or to some portion of the subterranean formation adjacent or proximate thereto.

Figure 3:
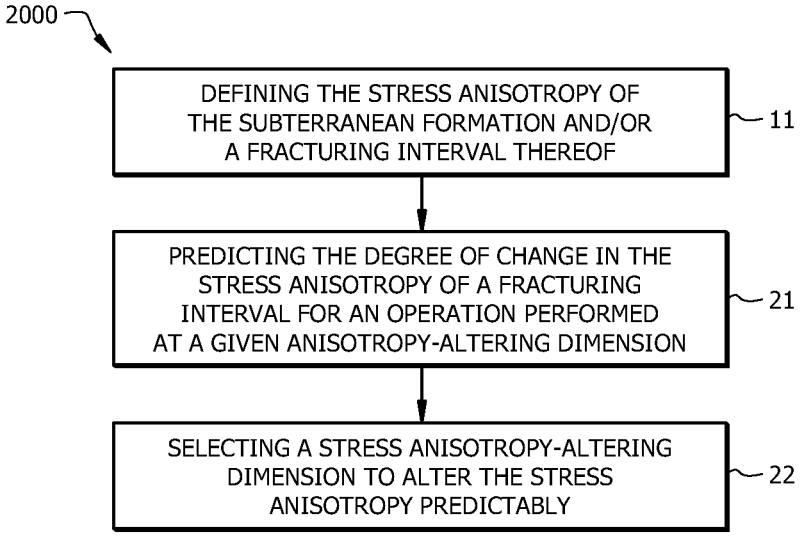
FIG. 3 is a diagram of a method of selecting a stress anisotropy-altering dimension.

Also disclosed herein are one or more methods, systems, and apparatuses suitably employed for determining a dimension to alter the stress anisotropy of a subterranean formation. Referring to FIG. 3, an embodiment of a method suitably employed to select a dimension to alter the stress anisotropy of a subterranean formation and/or a fracturing interval thereof, referred to herein as a stress anisotropy-altering dimension selection method (ADS) 2000, is illustrated graphically. In an embodiment, the ADS 2000 generally comprises defining the stress anisotropy of the subterranean formation and/or a fracturing interval thereof 11, predicting the degree of change in the stress anisotropy of the fracturing interval for an operation performed at a given anisotropy-altering dimension 21, and selecting a stress anisotropy-altering dimension so as to alter the stress anisotropy in a predictable way 22.

Figure 4:
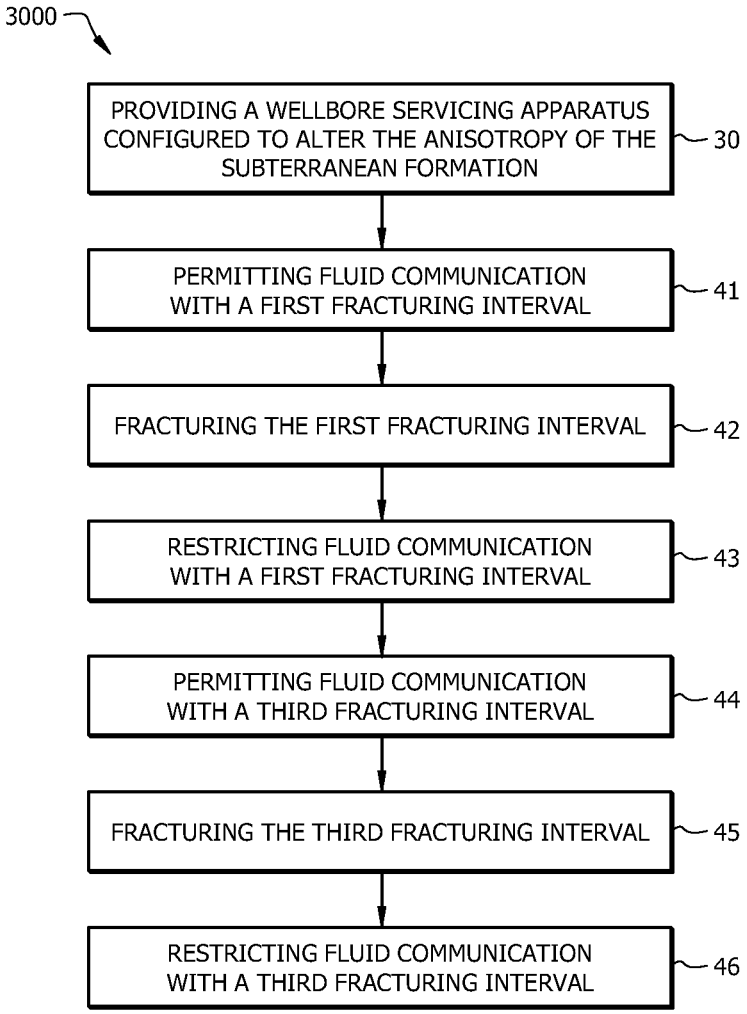
FIG. 4 is a diagram of a method of altering the stress anisotropy within a fracturing interval of a subterranean formation or a portion thereof.

Also disclosed herein are one or more methods, systems, and apparatuses suitably employed for altering the stress anisotropy of a target fracturing interval of a subterranean formation. Referring to FIG. 4, an embodiment of a method suitably employed to alter the stress anisotropy of the target fracturing interval of the subterranean formation, referred to herein as a stress anisotropy-altering method (SAA) 3000, is illustrated graphically. In an embodiment, the SAA 3000 generally comprises providing a wellbore servicing apparatus configured to allow alteration of the anisotropy of the subterranean formation 30 by a fracturing treatment, permitting fluid communication with a first fracturing interval 41 (wherein the first fracturing interval is adjacent to the fracturing interval in which the stress anisotropy is to be altered), fracturing the first fracturing interval 42, restricting fluid communication with the first fracturing interval 43, permitting fluid communication with a third fracturing interval 44 (wherein the third fracturing interval is adjacent to the fracturing interval in which the stress anisotropy is to be altered), fracturing the third fracturing interval 45, and restricting fluid communication with the third fracturing interval 46.

Referring to FIG. 1, in an embodiment the FCI 1000 may optionally comprise characterizing the subterranean formation 10. In such an embodiment, characterizing the subterranean formation 10 may comprise defining the stress anisotropy of the subterranean formation, determining the presence, degree, and/or orientation of any natural fractures, determining the mechanical properties of the subterranean formation, or combinations thereof.

In an embodiment, characterizing the subterranean formation 10 may suitably comprise defining the stress anisotropy of the subterranean formation and/or a fracturing interval thereof. In an embodiment, the ADS 2000 also comprises defining the stress anisotropy of the subterranean formation and/or a fracturing interval thereof 11. As used herein, "stress anisotropy" refers to the difference in magnitude between a maximum horizontal stress and a minimum horizontal stress.

Figure 5A:
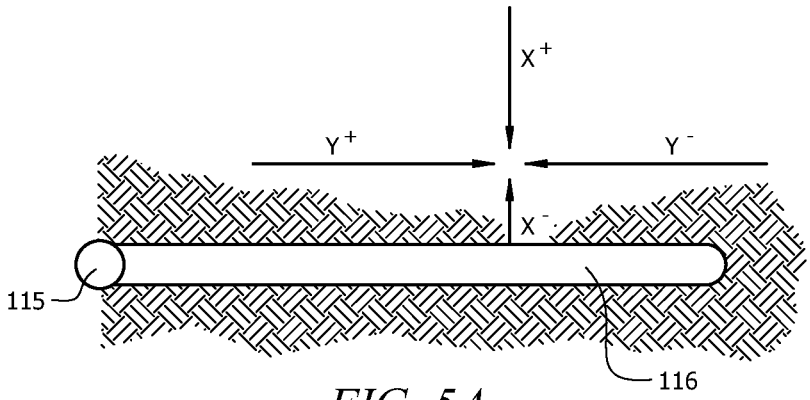
FIG. 5A is a horizontal cross-section (i.e., a top-view) extending through a subterranean formation illustrating the principal stresses acting therein.
Figure 5B:
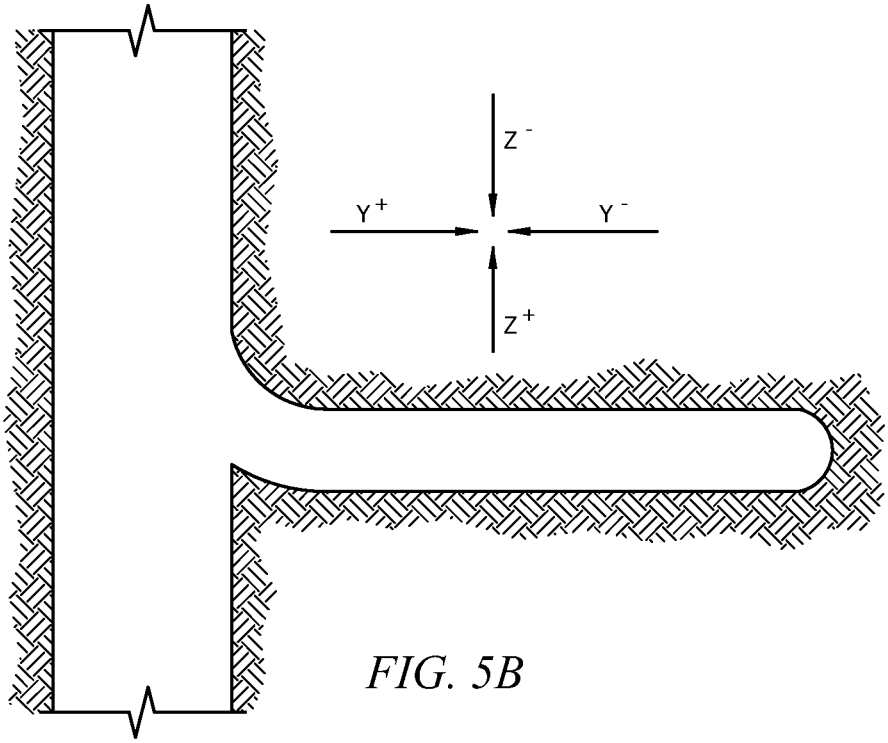
FIG. 5B is a vertical cross-section (i.e., a side view) extending through a subterranean formation illustrating the principal stresses acting therein.

As will be appreciated by those of skill in the art, stresses of varying magnitudes and orientations may be present within a hydrocarbon-containing subterranean formation. Although the various stresses present may be many, the stresses may be effectively simplified to three principal stresses. For example, referring to FIGS. 5A and 5B, the various forces acting at a given point within a subterranean formation are illustrated. FIG. 5A illustrates a horizontal plane extending through the subterranean formation 102 (i.e., a top view as if looking down a wellbore) and horizontally-acting forces along an x axis and along a y axis (in this figure, vertically-acting forces, for example, along a z axis would extend in a direction perpendicular to this plane). Similarly, FIG. 5B illustrates a vertical plane extending through the subterranean formation 102 (i.e., a side view of a wellbore) and horizontally-acting forces along the y axis and vertically-acting forces along the z axis (in this figure, horizontally-acting forces, for example, along a x axis would extend in a direction perpendicular to this plane). As shown in FIGS. 5A and 5B, the forces may be simplified to two horizontally-acting forces (i.e., the x axis and the y axis), and one vertically-acting force (i.e., the z axis).

In an embodiment, it may be assumed that the stress acting along the z axis is approximately equal to the weight of formation above (e.g., toward the surface) a given location in the subterranean formation 102. With respect to the stresses acting along the horizontal axes, cumulatively referred to as the horizontal stress field, for example in FIG. 5A, the x axis and the y axis, one of these principal stresses may naturally be of a greater magnitude than the other. As used herein, the "maximum horizontal stress" or $\sigma_{HMax}$ refers to the orientation of the principal horizontal stress having the greatest magnitude and the "minimum horizontal stress" or $\sigma_{HMin}$ refers to the orientation of the principal horizontal stress having the least magnitude. As will be appreciated by one of skill in the art, the $\sigma_{HMax}$ may be perpendicular to the $\sigma_{HMin}$. Unless otherwise specified, as used herein "stress anisotropy" refers to the difference in magnitude between the $\sigma_{HMax}$ and the $\sigma_{HMin}$.

In an embodiment, determining the stress anisotropy of a subterranean formation comprises determining the $\sigma_{HMax}$, the $\sigma_{HMin}$, or both. In an embodiment, the $\sigma_{HMax}$, the $\sigma_{HMin}$, or both may be determined by any suitable method, system, or apparatus. Nonlimiting examples of methods, systems, or apparatuses suitable for determining the $\sigma_{HMin}$ include a logging run with a dipole sonic wellbore logging instrument, a wellbore breakout analysis, a fracturing analysis, a fracture pressure test, or combinations thereof. In an embodiment, the $\sigma_{HMax}$ may be calculated from the $\sigma_{HMin}$.

Because stress anisotropy refers to the difference in the magnitude of the $\sigma_{HMax}$ and the $\sigma_{HMin}$, the stress anisotropy may be calculated after the $\sigma_{HMax}$ and the $\sigma_{HMin}$ have been determined, for example, as shown in Equation I:

$$\text{Stress Anisotropy}=\sigma_{HMax}-\sigma_{HMin}$$

In an embodiment, characterizing the subterranean formation 10 may suitably comprise determining the presence, degree, and/or orientation of any natural fractures. As will be explained in greater detail herein below, the presence, degree, and orientation of fractures occurring naturally within a subterranean formation may affect how a fracture forms therein. Nonlimiting examples of methods, systems, or apparatuses suitable for determining the presence, degree, orientation, or combinations thereof of any naturally occurring fractures include imaging the wellbore (e.g., as by an image log), extracting and analyzing a core sample, the like, or combinations thereof.

In an embodiment, characterizing the subterranean formation 10 may suitably comprise determining the mechanical properties of the subterranean formation, a portion thereof, or a fracturing interval. Nonlimiting examples of the mechanical properties to be obtained include the Young's Modulus of the subterranean formation, the Poisson's ratio of the subterranean formation, Biot's constant of the subterranean formation, or combinations thereof.

In an embodiment, the mechanical properties obtained for the subterranean formation may be employed to calculated or determine the "brittleness" of various portions of the subterranean formation. Alternatively, in an embodiment the brittleness may be measured as by any suitable means. As will be discussed in greater detail herein below, it may be desirable to locate portions of the subterranean formation which may be qualitatively characterized as brittle. Alternatively, it may be desirable to quantify the degree to which a subterranean formation, a portion thereof, or a fracturing interval may be characterized as brittle so as to determine the portion of the subterranean formation 102 that is most and/or least brittle. Brittleness characterizations are discussed in greater detail in Mike Mullen et al., "A Composite Determination of Mechanical Rock Properties for Stimulation Design (What To Do When You Don't Have a Sonic Log)," SPE108139, 2007 SPE Rocky Mountain Oil & Gas Technology Symposium in Denver, Colo.; Donald Kundert et al., "Proper Evaluation of Shale Gas Reservoirs Leads to a More Effective Hydraulic-Fracture Stimulation," SPE123586, 2009 SPE Rocky Mountain Oil & Gas Technology Symposium in Denver, Colo.; and Rick Rickman et al., "A Practical Use of Shale Petrophysic for Stimulation Design Optimization: All Shale Plays Are Not Clones of the Barnett Shale," SPE115258, 2008 SPE Annual Technical Conference and Exhibition in Denver Colo., each of which is incorporated herein by reference in its entirety.

Methods of determining the mechanical properties of a subterranean formation 102 are generally known to one of skill in the art. Nonlimiting examples of methods, systems, or apparatuses suitable for determining the mechanical properties of the subterranean formation include a logging run with a dipole sonic wellbore logging instrument, extracting and analyzing a core sample, the like, or combinations thereof. In an embodiment, one or more of the methods employed to determine one or more characteristics of the subterranean formation 102 may be performed within a vertical wellbore portion 115, a deviated wellbore portion 116, or both. In an embodiment, one or more of the methods employed to determine one or more characteristics of the subterranean formation 102 may be performed in an adjacent or substantially nearby wellbore (e.g. an offset or monitoring well).

Referring to FIG. 1, in an embodiment, a fracture complexity inducing method suitably may comprise providing a horizontal or deviated wellbore portion 116. In an embodiment, one or more of the characteristics of the subterranean formation 102 may be employed in placing and/or orienting the deviated wellbore portion 116. In an embodiment, the deviated wellbore portion 116 may be oriented approximately parallel to the orientation of the $\sigma_{HMin}$ and approximately perpendicular to the orientation of the $\sigma_{HMax}$.

In an embodiment, the deviated wellbore portion 116 may be provided so as to penetrate, lie adjacent to, and/or lie proximate to a portion of the subterranean formation 102 which is more brittle (e.g., having a relatively high brittleness) than another portion of the subterranean formation 102 (e.g., relative to an adjacent, proximate, and/or nearby subterranean formation). Not seeking to be bound by theory, by providing the deviated wellbore portion 116 within and/or near a brittle portion of the subterranean formation 102, a fracture introduced into that portion of the subterranean formation 102 may have a lower tendency to close or "heal." For example, highly malleable or ductile portions of a subterranean formation (e.g., those portions having relatively low brittleness) may have a greater tendency to close or heal after a fracture has been introduced therein. In an embodiment, it may be desirable to introduce fractures into a portion of the subterranean formation 102 and/or a fracturing interval thereof having a low tendency to close or heal after a fracture has been introduced therein.

In an embodiment, the deviated wellbore portion 116 may be provided so as to penetrate, lie adjacent to, and/or lie proximate to a portion of a subterranean formation having one or more naturally occurring fractures. In an alternative embodiment, the deviated wellbore portion 116 may be provided so as to penetrate, lie adjacent to, and/or lie proximate to a portion of a subterranean formation having no, alternatively, very few, naturally occurring fractures. Not seeking to be bound by theory, by providing the deviated wellbore portion 116 within and/or near a portion of the subterranean formation 102 having naturally occurring fractures, a fracture introduced therein may have a greater tendency to cause natural fractures to be opened, thereby achieving greater fracturing complexity.

In an embodiment the FCI 1000, may suitably comprise defining at least one anisotropy-altering dimension 20. As used herein, "anisotropy-altering dimension" refers to a dimension (e.g., a magnitude, measurement, quantity, parameter, or the like) that, when employed to introduce a fracture within the subterranean formation 102 for which it was defined, may alter the stress anisotropy of the subterranean formation to yield or approach a predictable result.

Not intending to be bound by theory, the presence of horizontal stress anisotropy, that is, a difference in the magnitude of the $\sigma_{HMin}$ and the magnitude of the $\sigma_{HMax}$ within the subterranean formation 102 and/or a fracturing interval thereof, may affect the way in which a fracture introduced therein will extend. The presence of horizontal stress anisotropy may impede the formation of or hydraulic connectivity to complex fracture networks. For example, the presence of horizontal stress anisotropy may cause a fracture introduced therein to open in substantially only one direction. Not seeking to be bound by theory, when a fracture forms within a subterranean formation and/or a fracturing interval thereof, the subterranean formation is forced apart at the forming fracture(s). Not seeking to be bound by theory, because the stress in the subterranean formation and/or a fracturing interval thereof is greater in an orientation parallel to the orientation of the $\sigma_{HMax}$ than the stress in the subterranean formation and/or a fracturing interval thereof in an orientation parallel to the orientation of the $\sigma_{HMin}$, a fracture in the subterranean formation may resist opening perpendicular to (e.g., being forced apart in a direction perpendicular to) the orientation of the $\sigma_{HMax}$. For example, a fracture may be impeded from being forced apart in a direction perpendicular to the direction of $\sigma_{HMax}$ to a degree equal to the stress anisotropy.

Figure 6A:
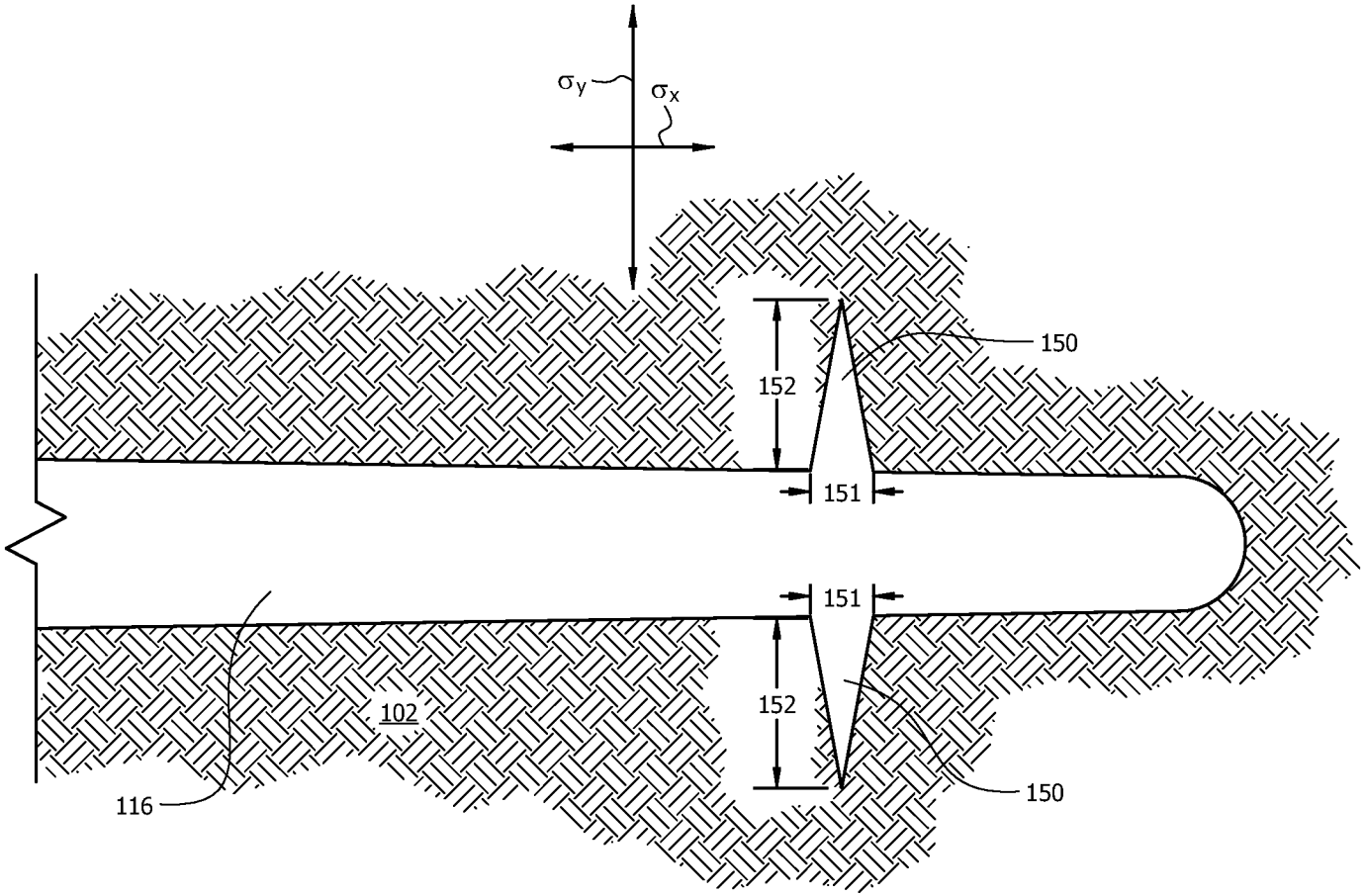
FIG. 6A is a horizontal cross-section extending through a subterranean formation illustrating the principal stresses acting therein as a fracture is initiated therein.

Referring to FIG. 6A, a horizontal plane extending through the subterranean formation 102 is illustrated. Deviated wellbore portion 116 extends through the subterranean formation 102. Lines $\sigma_x$ and $\sigma_y$ represent the net major and minor principal horizontal stresses present within the subterranean formation 102. A fracture 150 is shown forming in the subterranean formation 102. In the embodiment of FIG. 6A, $\sigma_x$ represents the $\sigma_{HMin}$ and $\sigma_y$ represents the $\sigma_{HMax}$ (note that the length of lines $\sigma_y$ and $\sigma_x$ corresponds to the magnitude of the stress applied along these axes; the length of line $\sigma_y$ is greater than the length of line $\sigma_x$, indicating that the magnitude of the stress is greater along the line $\sigma_y$). As illustrated in FIG. 6A, because less resistance is applied against the subterranean formation 102 along line $\sigma_x$ (e.g., the $\sigma_{HMin}$), the fracture 150 may form such that the subterranean formation 102 is forced apart in a direction perpendicular to line $\sigma_x$. Thus, the fracture 150 may tend to form such that the fracture width 151 (e.g., the distance between the faces of the fracture 150) may be approximately parallel to the $\sigma_{HMin}$ and the fracture length 152 may be approximately parallel to the $\sigma_{HMax}$.

Figure 6B:
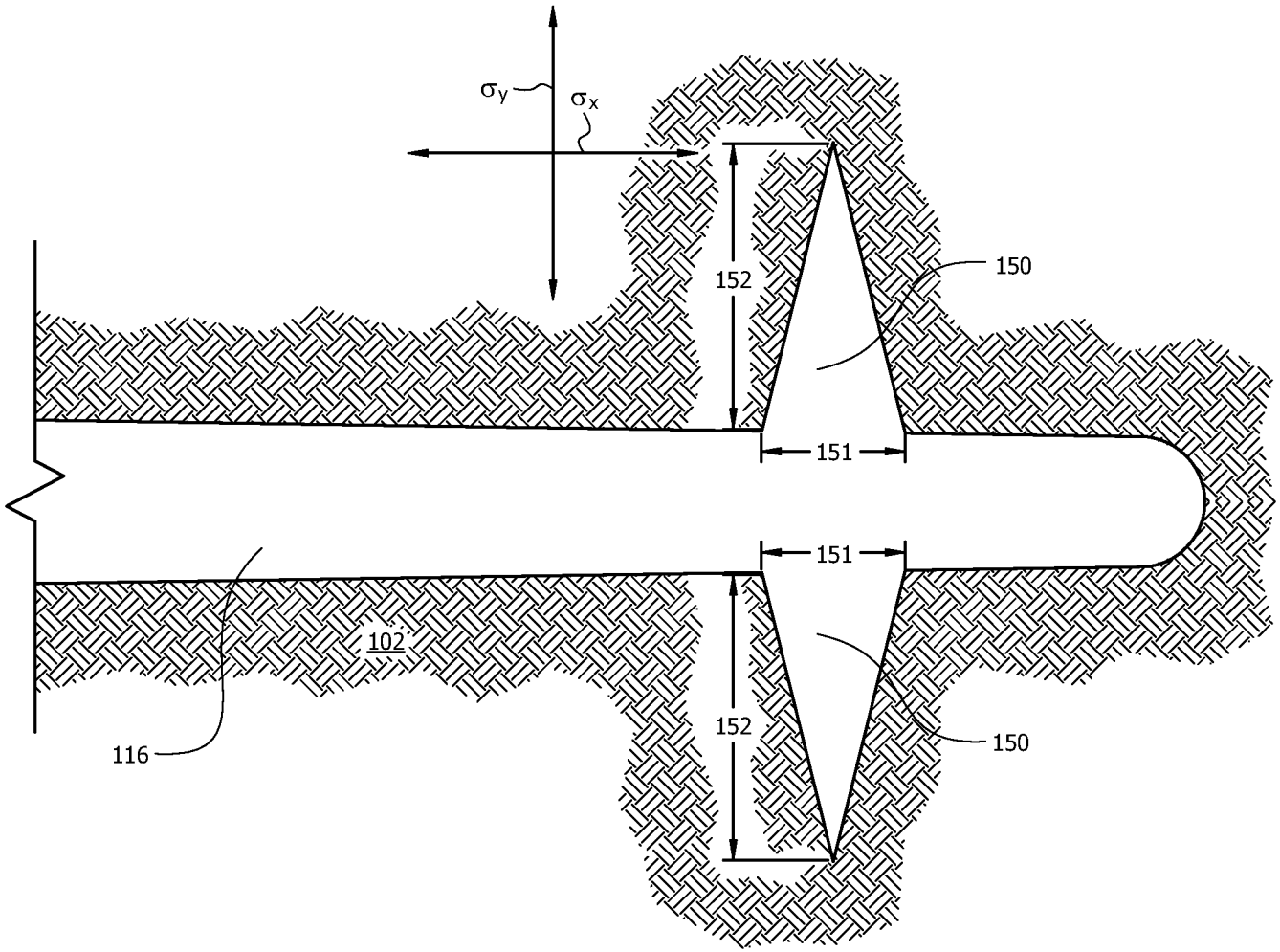
FIG. 6B is a horizontal cross-section extending through a subterranean formation illustrating the principal stresses acting therein after a fracture has been introduced therein.

In an embodiment, introducing the fracture 150 into the subterranean formation 102 may cause a change in the magnitude and/or direction of the $\sigma_{HMin}$, the $\sigma_{HMin}$, or both. In an embodiment, the magnitude of the $\sigma_{HMin}$ and the $\sigma_{HMax}$ may change at different rates. Referring to FIG. 6B, the effect of introducing fracture 150 in the subterranean formation 102 is illustrated. In an embodiment, the $\sigma_{HMin}$, the $\sigma_{HMax}$, or both may increase in magnitude as a result of introducing fracture 150 into the subterranean formation 102. Not intending to be bound by theory, because the introduction of fracture 150 forces the subterranean formation 102 apart in a direction parallel to the $\sigma_{HMin}$, the magnitude of the $\sigma_{HMin}$ may increase. The change in the $\sigma_{HMin}$, referred to herein as the $\Delta\sigma_{HMin}$, may be greater than the change in the $\sigma_{HMax}$, referred to herein as the $\Delta\sigma_{HMax}$. For example, referring to FIGS. 6A and 6B, the change in the $\sigma_{HMin}$ and the $\sigma_{HMax}$ due to the introduction of fracture 150 into the subterranean formation 102 is illustrated graphically. As shown in FIG. 6A, the magnitude along line $\sigma_y$, which is the $\sigma_{HMin}$, is significantly greater than the magnitude along line $\sigma_x$, which is $\sigma_{HMin}$. Referring to FIG. 6B, after the fracture 150 has been introduced into the formation, the both the $\sigma_{HMax}$ and the $\sigma_{HMin}$ have increased in magnitude and the $\sigma_{HMin}$ has increased more than the $\sigma_{HMax}$. That is, in this embodiment, the $\Delta\sigma_{HMin}$ and the $\Delta\sigma_{HMax}$ are both positive and, the $\Delta\sigma_{HMin}$ is greater than the $\Delta\sigma_{HMax}$. In an embodiment where introducing the fracture 150 into the subterranean formation 102 causes the magnitude of the $\sigma_{HMin}$ to increase at a greater rate than the rate at which the magnitude of the $\sigma_{HMax}$ increases, the magnitude of the $\sigma_{HMin}$ may approach the $\sigma_{HMax}$, equal the $\sigma_{HMax}$, or exceed the $\sigma_{HMax}$. As such, the difference in the magnitude of the $\sigma_{HMax}$ and the $\sigma_{HMin}$, that is, the stress anisotropy, following the introduction of fracture 150 into the subterranean formation 102 and/or a fracturing interval thereof, may be less than the stress anisotropy prior to the introduction of fracture 150. In an embodiment, the magnitude of the $\Delta\sigma_{HMin}$, the $\Delta\sigma_{HMax}$, or both may be dependent upon various other factors as will be discussed in greater detail herein below (e.g., a net extension pressure) and may vary in relation to the distance from the face of fracture.

Not intending to be bound by theory, when the magnitude of the stress applied along line $\sigma_x$ (e.g., $\sigma_{HMin}$ prior to fracturing) equals the magnitude of the stress applied along line $\sigma_y$ (e.g., $\sigma_{HMax}$ prior to fracturing) the horizontal stress anisotropy may be equal to zero. Where the horizontal stress anisotropy of a the subterranean formation and/or a fracturing interval thereof, equals zero, alternatively, about or substantially equals zero, alternatively, approximates zero, a fracture which is introduced therein may not be restricted to opening in only one direction. Not intending to be bound by theory, because the stresses applied within the subterranean formation and/or a fracturing interval thereof are equal, alternatively, about or substantially equal, a fracture introduced therein may open in any, alternatively, substantially any direction because the subterranean formation does not impede the fracture from opening in a particular direction. As such, in an embodiment where the stress anisotropy equals, alternatively, about or substantially equals, alternatively, approaches zero, branched fractures resulting in complex fracture networks may be allowed to form.

Alternatively, in an embodiment the magnitude along line $\sigma_x$ (e.g., $\sigma_{HMin}$ prior to fracturing) may increase so as to exceed the magnitude along line $\sigma_y$ (e.g., $\sigma_{HMax}$ prior to fracturing). In such an embodiment, the stress field may be altered such that the $\sigma_{HMax}$ prior to the introduction of the fracture becomes the $\sigma_{HMin}$ and the $\sigma_{HMin}$ prior to the introduction of the fracture becomes $\sigma_{HMax}$ (e.g., the magnitude along line $\sigma_x$ after fracturing is greater than the magnitude along line $\sigma_y$ after fracturing). In an embodiment where the stress field in a subterranean formation and/or a fracturing interval thereof is reversed as such, a fracture introduced therein may open perpendicular to the direction in which a fracture introduced therein might have opened prior to the reversal of the stress field and thereby encouraging the creation of complex fracture networks.

Figure 7:
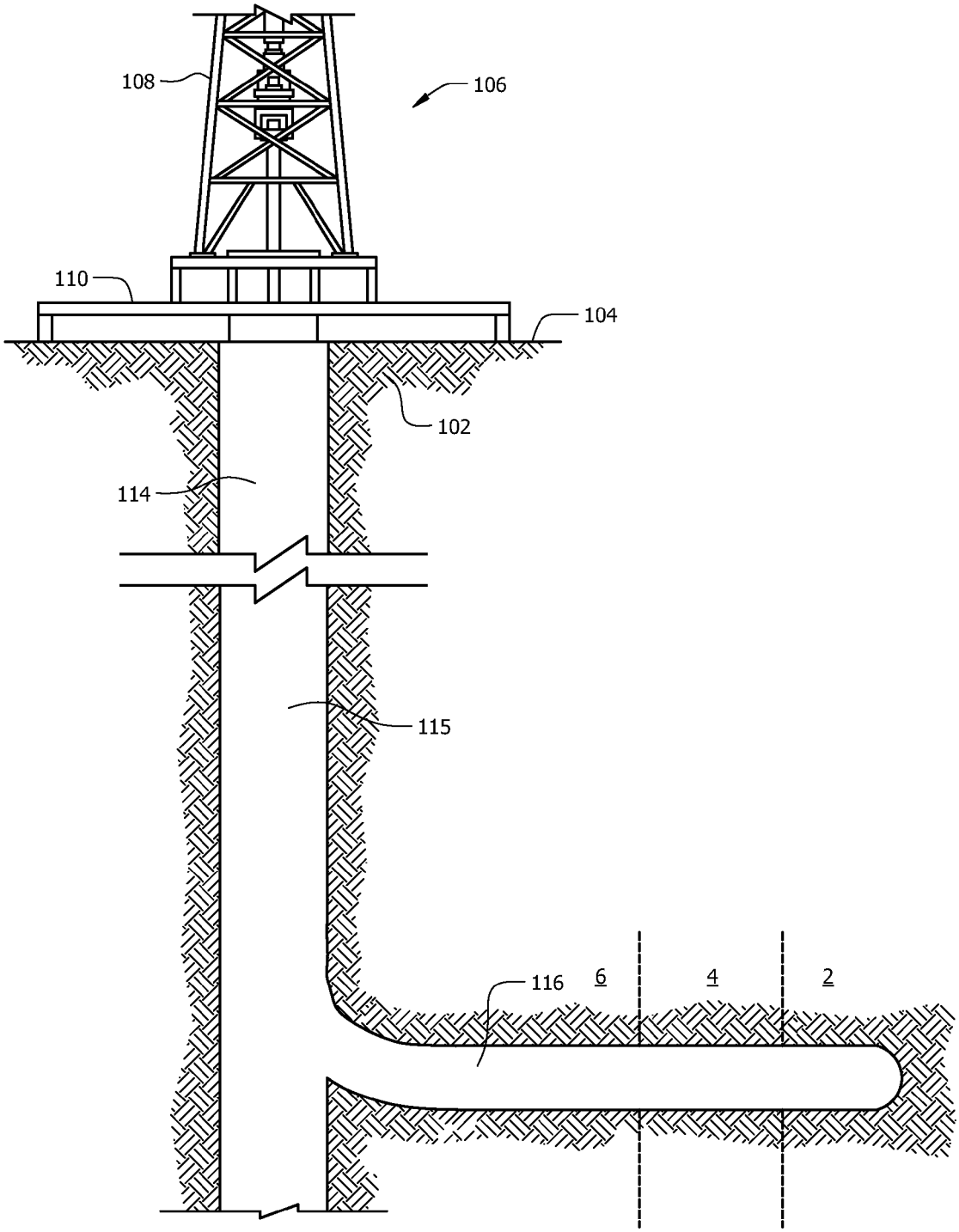
FIG. 7 is a partial cutaway view of a wellbore penetrating a subterranean formation illustrating multiple fracturing intervals along a deviated portion of a wellbore.

In an embodiment, an anisotropy-altering dimension may be calculated or otherwise determined such that when one or more fractures are introduced into a subterranean formation and/or fracturing intervals thereof, the anisotropy within some portion of the subterranean formation may be altered in a predictable way and/or to achieve a predictable anisotropy. For example, in an embodiment, the anisotropy-altering dimension may be calculated such that when a fracture is introduced into a subterranean formation and/or a fracturing interval thereof, the anisotropy within an adjacent and/or proximate fracturing interval of the subterranean formation into which the fracture is introduced may be altered in a substantially predictable way. Referring to FIG. 7, a fracture introduced into the subterranean formation 102 at fracturing interval 2 may alter the stress anisotropy therein as well as the stress anisotropy within fracturing intervals 4 and 6. Likewise, fractures introduced into the subterranean formation 102 at fracturing intervals 4 and 6 may alter the stress anisotropy elsewhere in other fracturing intervals of the subterranean formation 102.

In an embodiment, the anisotropy-altering dimension may be calculated such that a fracture introduced into a subterranean formation 102 may lessen the anisotropy (e.g., the difference between the $\sigma_{HMax}$ and the $\sigma_{HMin}$ following the introduction of the fracture(s) is less than the difference between the $\sigma_{HMax}$ and the $\sigma_{HMin}$ prior to the introduction of those fractures) alternatively, reduce the anisotropy to approximately equal to zero (e.g., the difference between the $\sigma_{HMax}$ and the $\sigma_{HMin}$, following the introduction of the fracture(s) is about zero). In an embodiment, the anisotropy-altering dimension may be calculated such that a fracture introduced into a subterranean formation 102 may reverse the anisotropy (e.g., following the introduction of fractures, the magnitude in the orientation of the original $\sigma_{HMin}$ is greater than the magnitude in the orientation of the original As explained herein above, the introduction of a fracture into a fracturing interval (e.g., 2, 4, 6, etc.) of the subterranean formation 102 may alter the horizontal stress field of the subterranean formation (e.g., the fracturing interval into which the fracture was introduced, a fracturing interval adjacent to the fracturing interval into which the fracture was introduced, a fracturing interval proximate to the fracturing interval into which the fracture was introduced, or combinations thereof.

In an embodiment, the anisotropy-altering dimension comprises a fracturing interval spacing. As used herein "fracturing interval spacing" refers to the distance parallel to the axis of the deviated wellbore portion 116 between a first fracturing interval and a second fracturing interval (e.g., the point at which a first fracture is introduced into the subterranean formation 102 and the point at which a second fracture is introduced into the subterranean formation 102).

In an embodiment, the anisotropy-altering dimension comprises a net fracture extension pressure. As used herein the phrase "net fracture extension pressure" refers to the pressure which is required to cause a fracture to continue to form or to be extended within a subterranean formation. In an embodiment, the net fracture extension pressure may be influenced by various factors, nonlimiting examples of which include fracture length, presence of a proppant within the fracture and/or fracturing fluid, fracturing fluid viscosity, fracturing pressure, the like, and combinations thereof.

In an embodiment, defining an anisotropy-altering dimension 20 may comprise predicting the degree of change in the stress anisotropy of a fracturing interval for an operation preformed at a given anisotropy-altering dimension. In an embodiment, the ADS 2000 may also comprise predicting the degree of change in the stress anisotropy of a fracturing interval for an operation preformed at a given anisotropy-altering dimension 21

In an embodiment, predicting the change in the stress anisotropy of fracturing interval comprises developing a fracturing model indicating the effect of introducing one or more fractures into the subterranean formation. A fracturing model may be developed by any suitable methodology. In an embodiment, a graphical analysis approach may be employed to develop the fracture model. In an embodiment, a fracturing model developed for a given region may be applicable elsewhere within that region (e.g., a correlation may be drawn between a fracturing model developed for a given locale and another locale within a same or similar formation, region, wellbore, or the like).

In an embodiment, a graphical analysis approach to developing a fracture model comprises utilizing the mechanical properties of the subterranean formation (e.g., Young's' Modulus, Poisson's ratio, Biot's constant, or combinations thereof) to calculate the expected net pressure during the introduction of a hydraulic fracture.

Where the stress field (e.g., magnitude and orientation of the $\sigma_{HMax}$ and the $\sigma_{HMin}$, as discussed above) is known, the change in stress in an area near or around a fracture due to the introduction of a fracture may be calculated using analytical or numerical approach. The change in stress may be directly correlated to (e.g., a function of) the net fracturing pressure.

Figure 8A:
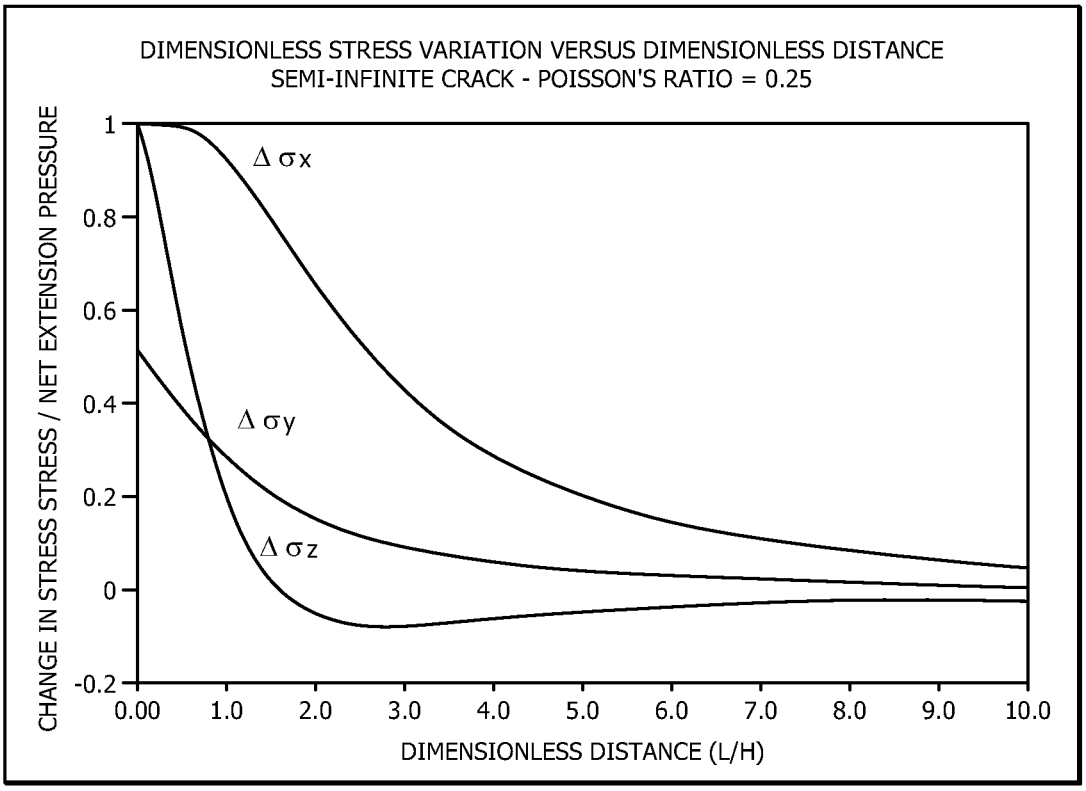
FIG. 8A is a graph for a semi-infinite fracture of the relationship between the ratio of change in stress to net extension pressure and the ratio of distance from the fracture to height of the fracture.

In an embodiment, any suitable analytical solutions may be employed. In an embodiment, the solution presented by Sneddon and Elliott for the calculation of the distribution of stress(es) in the neighborhood of a crack in an elastic medium is employed. To simplify the problem, Sneddon and Elliot assumed that the fracture is rectangular and of limited height while the length of the fracture is infinite. In practice, this means that the fracture's length is significantly greater than its height, at least by a factor of 5. It is also assumed (and validly so) that the width of the fracture is extremely small compared its height and length. Under such semi-infinite system, the components of stress may be affected. The final solution reached by Sneddon and Elliot is given in the equations below and illustrated in FIG. 8A. In FIG. 8A the dimensionless quantities, ratio of stress to net pressure, along a line perpendicular to the center of the fracture is plotted versus the dimensionless distance, ratio of distance to the height of the fracture.

$$\frac{1}{2}\left(\frac{\Delta\sigma_y}{p_o}+\frac{\Delta\sigma_x}{p_o}\right)=\left\{\frac{r}{\sqrt{r_1 r_2}}\cos(\theta-0.5\theta_1-0.5\theta_2)-1\right\} \quad (1)$$

$$\frac{1}{2}\left(\frac{\Delta\sigma_y}{p_o}-\frac{\Delta\sigma_x}{p_o}\right)=\frac{2r\cos\theta}{H}\left(\frac{H^2}{4r_1 r_2}\right)^{3/2}\cos\left(\frac{3}{2}(\theta_1+\theta_2)\right) \quad (2)$$

$$\frac{\Delta\sigma_z}{p_o}=\nu\left(\frac{\Delta\sigma_x}{p_o}+\frac{\Delta\sigma_y}{p_o}\right) \quad (3)$$

Where:

$\theta$ is the angle from center of fracture to point,
$\theta_1$ is the angle from lower tip of fracture to point,
$\theta_2$ is the angle from upper tip of fracture to point,
r is the distance from center of fracture to point,
$r_1$ is the distance from lower fracture tip to point,
$r_2$ is the distance from upper fracture tip to point,
H is the fracture height,
$P_o$ is the net fracture extension pressure, and
$\nu$ is the Poisson's ratio.

In an alternative embodiment, any other suitable analytical solution may be employed for calculating the effect of a fracture in the case of penny shaped fracture, a randomly shaped fracture, or others. In an embodiment where the fracture traverses a boundary where the mechanical properties of the rock change, it may be necessary to use a numerical solution.

In an alternative embodiment, calculating the effect of the introduction of two or more fractures may comprise employing the principle of superposition. The principle of superposition is a mathematical property of linear differential equations with linear boundary conditions. To calculate the effect due to multiple fractures using the principle of superposition at a given point, the effect of each fracture on that point as if that fracture exists in an infinite system may be calculated. Algebraic addition of the effect of the various (e.g., two or more) fractures yields the cumulative effect of the introduction of those fractures. The fractures need not be identical in size in order to apply this principle. The assumption of identical fractures is only one of convenience.

Figure 8B:
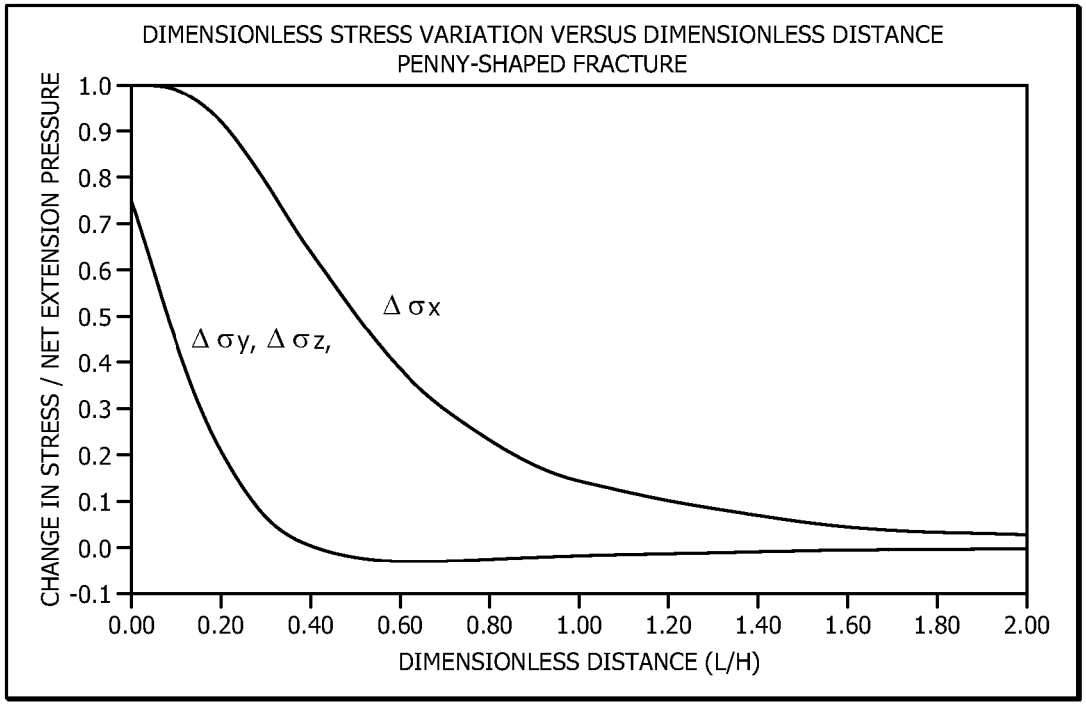
FIG. 8B is a graph for a penny-shaped fracture of the relationship between the ratio of change in stress to net extension pressure and the ratio of distance from the fracture to height of the fracture.
Figure 8C:
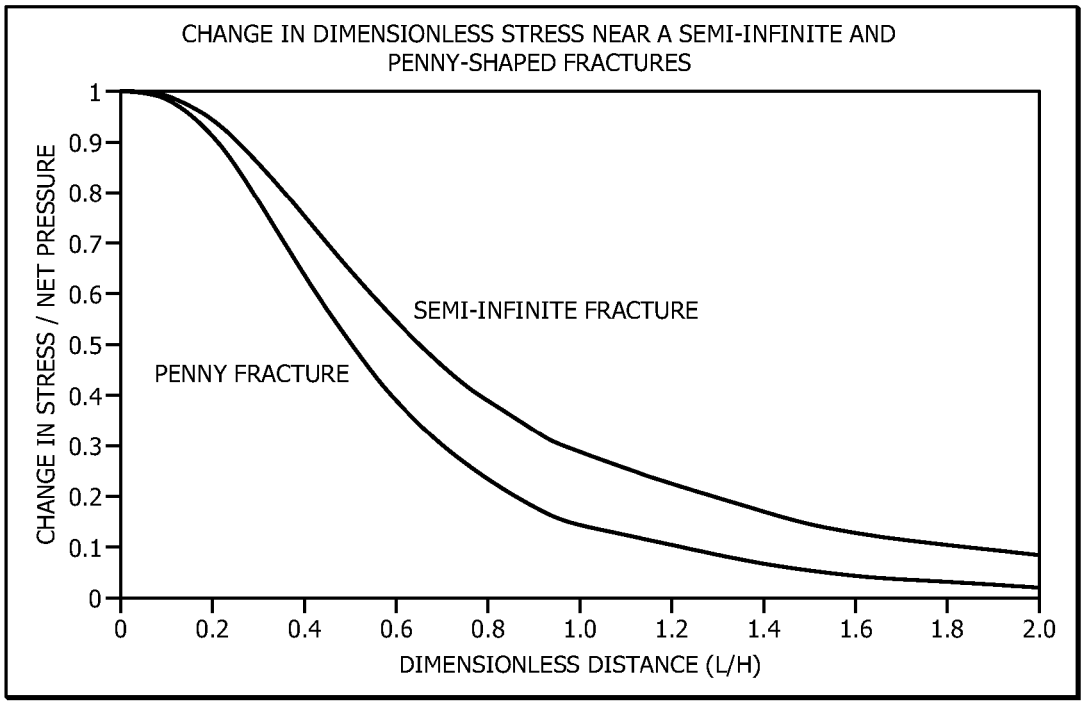
FIG. 8C is a graph for semi-infinite and penny-shaped fractures of the relationship between the ratio of change in stress to net extension pressure and the ratio of distance from the fracture to height of the fracture.

Referring to FIGS. 8A, 8B, and 8C, suitable models are illustrated. FIG. 8A demonstrates the variation of the ratio of change in stress to net extension pressure with respect to the ratio of distance from the fracture (L) to height of the fracture (H) for a semi-infinite fracture (e.g., where the length of the fracture is presumed to be infinite). Similarly, FIG. 8B demonstrates the variation of the ratio of change in stress to net extension pressure with respect to the ratio of distance from the fracture (L) to height of the fracture (H) for a penny-shaped fracture (e.g., where the height of the fracture is presumed to be approximately equal to its length). FIG. 8C demonstrates the variation of the ratio of change in stress to net extension pressure with respect to the ratio of distance from the fracture (L) to height of the fracture (H) for both a semi-infinite fracture and a penny-shaped fracture.

Figure 9:
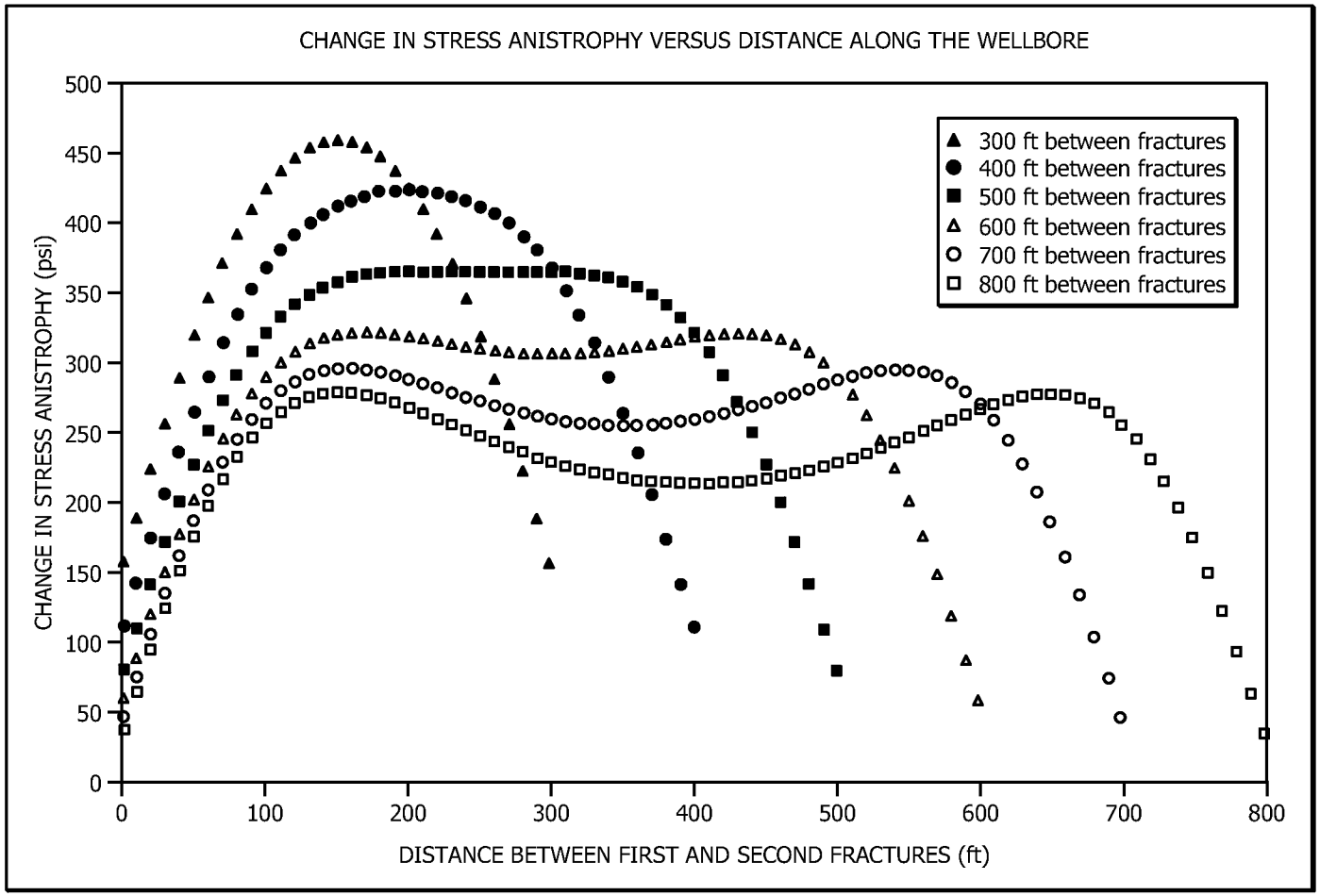
FIG. 9 is a graph of the relationship between change in stress anisotropy and distance between a first fracture and a second fracture.

In an embodiment, defining an anisotropy-altering dimension 20 may comprise selecting a stress anisotropy-altering dimension to alter the stress anisotropy predictably. Also, referring to FIG. 3, in an embodiment, the ADS 2000 may comprise selecting a stress anisotropy-altering dimension to alter the stress anisotropy predictably 22. In an embodiment, by presuming a net fracture extension pressure and employing at least one of the relationships between the ratio of change in stress to net extension pressure and the ratio of distance from the fracture (L) to height of the fracture (H) (e.g., as illustrated in FIGS. 8A, 8B, and 8C) it is possible to develop a model of the change in stress anisotropy as a function of the effect the distance between multiple fractures. For example, referring to FIG. 9, an illustration of the change in stress anisotropy of the subterranean formation and/or a fracturing interval thereof between two fractures is shown as a function of the distance along the deviated wellbore portion between a first fracture and a second fracture. Thus, a fracturing interval spacing may be selected to achieve a desired change in anisotropy.

Figure 10:
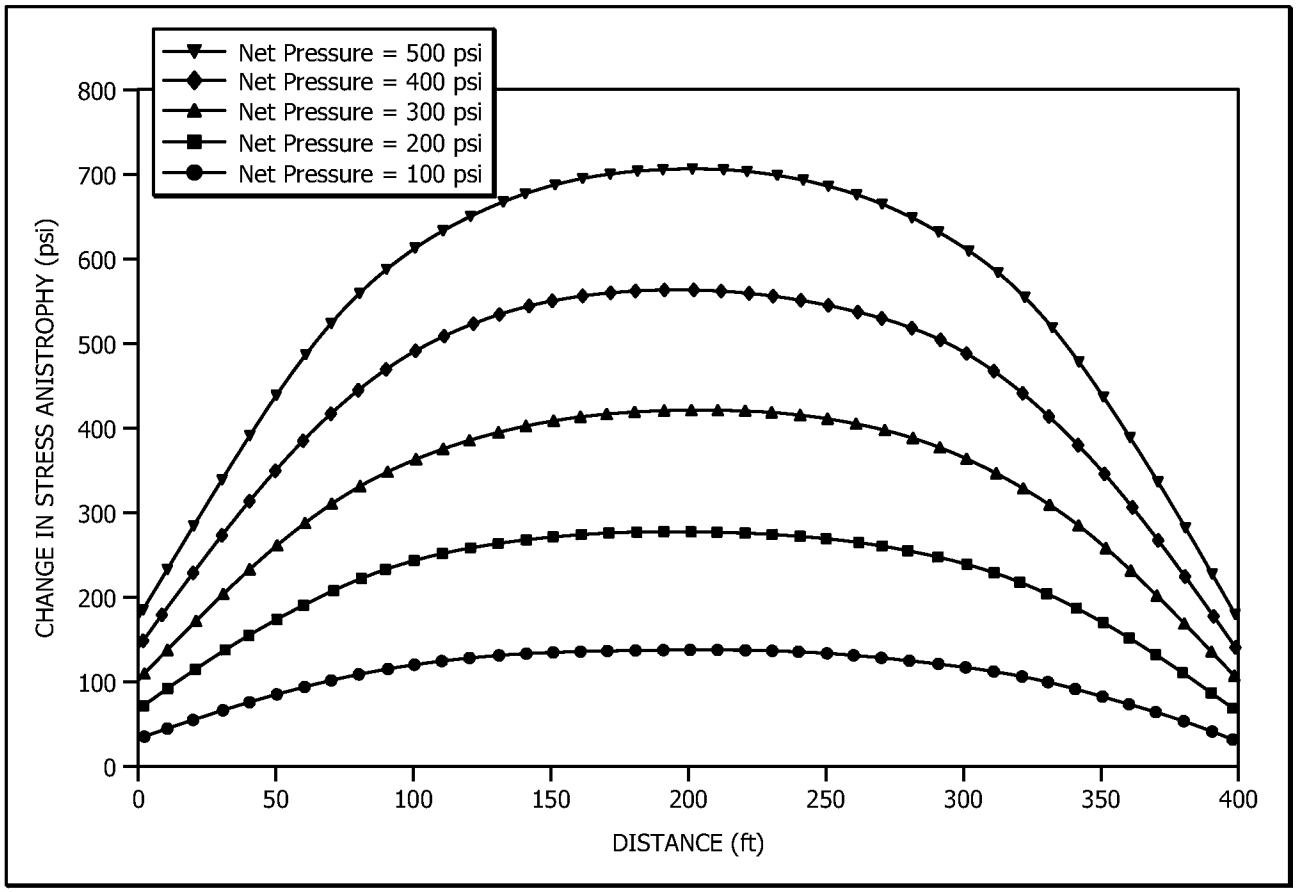
FIG. 10 is a graph of the relationship between change in stress anisotropy and distance between a first fracture and a second fracture for various net extension pressures.

In an alternative embodiment, by presuming a fracturing interval spacing and employing at least one of the relationships between the ratio of change in stress to net extension pressure and the ratio of distance from the fracture (L) to height of the fracture (H) (e.g., as illustrated in FIGS. 8A, 8B, and 8C) it is possible to develop a model of the change in stress anisotropy as a function the distances on the change stress anisotropy at a point between those fractures. For example, referring to FIG. 10, an illustration of the change in stress anisotropy of a portion of the subterranean formation and/or a fracturing interval thereof between two fractures is shown as a function of the net fracture extension pressure. Thus, a net fracture extension pressure may be selected to achieve a desired change in anisotropy.

In an alternative embodiment, a mathematical approach may be employed to predict the change in the stress anisotropy of a fracturing interval, calculate a fracturing interval spacing, calculate a net fracture extension pressure, or combinations thereof. In an embodiment, a fracture may be designed (e.g., as to fracturing interval spacing, net fracture extension pressure, or combinations thereof) using a simulator that may be 2-D, pseudo-3D or full 3-D. Simulator output gives the expected net pressure for a specific fracture design as well as anticipated fracture dimensions. In 2-D models, fracture height may be an assumed input and may be estimated in advance from the various logs defining the lithological and stress variation of the sequence of formations. In pseudo 3-D and full 3-D models, those lithological and stress variations may be part of the input and contribute to the calculation of fracture height. The net fracture extension pressure may be a function of reservoir mechanical properties, fracture dimensions, and degree of fracture complexity. The fracture height and length may be validated using monitoring techniques such as tilt meter placed inside the well, or microseismic events.

In an embodiment, fracture dimensions may be designed to achieve optimum complexity. Once height and net pressure are determined for a fracture design, the technique described above is used to calculate a distance from the first fracture such that when a second fracture is placed, the stress anisotropy would be effectively, or to some degree, neutralized.

In an embodiment, one of two situations may occur here. Where at least three fractures are to be introduced into the subterranean formation, the third fracture will be introduced between the first fracture and the second fracture. First, in an embodiment where the distance between the second and third fractures cannot be modified during a fracturing operation, then the creation of the first fracture may need to be monitored real time using analysis techniques, such as net pressure analysis (known as "Nolte-Smith" analysis), tiltmeters, microseismic analysis, or combinations thereof. The fracturing treatment may be modified to ensure that, within some tolerance, the fracture design parameters are achieved. This procedure may apply to the second or third fracture. Second, in an embodiment where the location of the second and third fractures may be modified during a fracturing operation, the stress model may be used to calculate new locations for the second fracture and/or the third fracture so as to alter (e.g., neutralize) the stress anisotropy within at least some portion of the subterranean formation. In an embodiment, the third fracture may be located at a point other than the exact halfway point between the first and second fractures. The location of the third fracture may depend upon the dimensions of the first and second fractures and upon the net pressures measured during the creation of the first and second fractures. In an embodiment, a conventional Nolte technique may be used during the treatment to identify times where fractures other than the fracture introduced into the formation (e.g., secondary fractures) are opening (e.g., ballooning); however. Alternatively, any suitable technique known to one of skill in the art or that may become known may be employed to identify opening (e.g., ballooning) of the secondary fractures.

Figure 11:
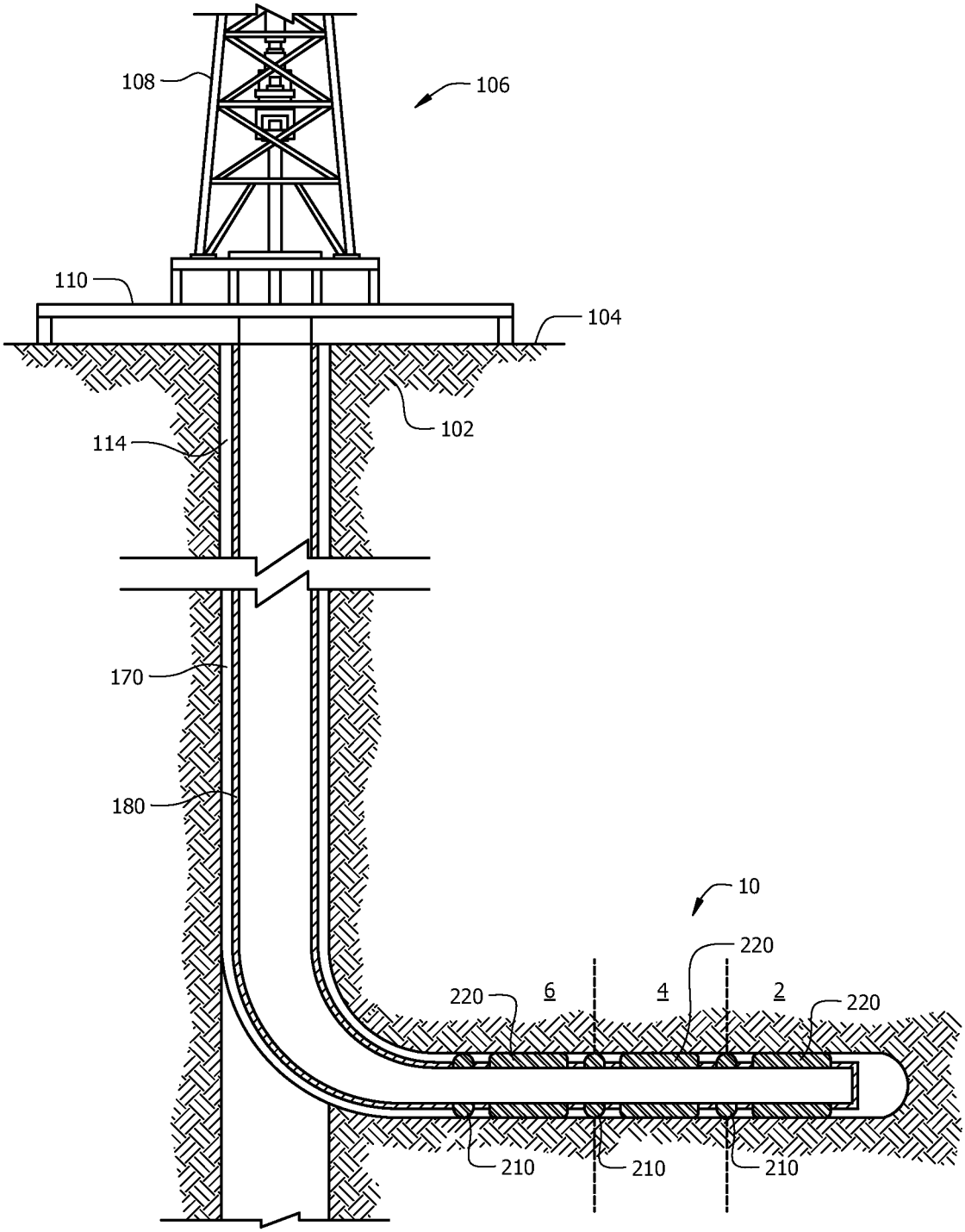
FIG. 11 is a partial cutaway view of a wellbore penetrating a subterranean formation illustrating a wellbore servicing apparatus comprising multiple manipulatable fracturing tools.

In an embodiment, the FCI 1000 comprises providing a wellbore servicing apparatus configured to alter the stress anisotropy of the subterranean formation 30. Referring to FIG. 11, at least a portion of a suitable wellbore servicing apparatus 200 is integrated within the casing string 180. In an alternative embodiment, at least a portion of a suitable wellbore servicing apparatus may be integrated within a liner, a coiled tubing string, the like, or combinations thereof.

In an embodiment, the wellbore servicing apparatus configured to alter the stress anisotropy of the subterranean formation 102 comprises one or more manipulatable fracturing tools (MFTs) 220. Referring to the embodiment of FIG. 11, the wellbore servicing apparatus 200 comprises a first MFT 220, a second MFT 220, and a third MFT 220. In an alternative embodiment, a wellbore servicing apparatus further comprises a fourth MFT, a fifth MFT, sixth MFT, or more. In an embodiment, the wellbore servicing apparatus 200 may comprise one or more lengths of tubing (e.g., casing members, liner members, etc.) connecting adjacent MFTs 220.

Continuing to refer to FIG. 11, in an embodiment, the wellbore servicing apparatus 200 may comprise one or more packers 210. The one or more packers may comprise any suitable apparatus for isolating adjacent or proximate portions of the wellbore 114 and/or the subterranean formation 102 to thereby form two or more fracturing intervals. In an embodiment, the one or more packers 210 may be provided between one or more MFTs 220 such that, when deployed, the packers 210 will effectively isolate the fracturing intervals from each other. Isolating the fracturing intervals from one another may comprise employing a form of annular isolation. Annular isolation refers to the provision of an axial hydraulic seal in the space between a tubing member (e.g., casing 180) and the wall of the wellbore 114. Annular isolation may be achieved via the implementation of a suitable packer or with cement. In an embodiment, the one or more packers 210 may comprise swellable packers, for example, a SwellPacker® swellable packer commercially available from Halliburton Energy Services in Duncan, Okla. Such a swellable packer may swellably expand upon contact with an activation fluid (e.g. water, kerosene, diesel, or others), thereby providing a seal or barrier between adjacent fracturing intervals. In such an embodiment, isolating the fracturing interval may comprise positioning the swellable packer adjacent to the fracturing interval to be isolated and contacting the swellable packer with an activation fluid.

In alternative embodiments, the one or more packers 210 comprise mechanical packers or inflatable packers. In such an embodiment, isolating the fracturing intervals (e.g., 2, 4, and/or 6) may comprise positioning the swellable packer between adjacent to the fracturing intervals (e.g., 2, 4, and/or 6) to be isolated and actuating the mechanical packer or inflating the inflatable packer. Alternatively, the one or more packers 210 comprise a combination of swellable packers and mechanical packers.

In an embodiment, providing a wellbore servicing apparatus configured to alter the stress anisotropy of the subterranean formation 102 may comprise positioning the wellbore servicing apparatus 200 within the wellbore 114 (e.g., the vertical wellbore portion 115, the horizontal wellbore portion 116, or combinations thereof). When positioned, each of the MFTs 220 comprised of the wellbore servicing apparatus 200 may be adjacent, substantially adjacent, and/or proximate to at least a portion of the subterranean formation 102 into which a fracture is to be introduced (e.g., a fracturing interval). For example, in the embodiment of FIG. 11, an MFT 220 is positioned substantially adjacent to a first fracturing interval 2, another MFT 220 is positioned adjacent to a second fracturing interval 4, and another MFT 220 is positioned adjacent to a third fracturing interval 6. Additionally, in an embodiment where a wellbore servicing apparatus a fourth MFT, a fifth MFT, sixth MFT, or more, each of the fourth MFT, the fifth MFT, the sixth MFT, or more may be positioned substantially adjacent to a fourth fracturing interval, a fifth fracturing interval, a sixth fracturing interval, etcetera, respectively.

In an embodiment, providing a wellbore servicing apparatus configured to alter the stress anisotropy of the subterranean formation comprises securing at least a portion of the wellbore servicing apparatus in position against the subterranean formation. In an embodiment, the casing 180 or portion thereof is secured into position against the subterranean formation 102 in a conventional manner using cement 170.

In an embodiment, the MFTs 220 may be configurable to either communicate a fluid between the interior flowbore of the MFT 220 and the wellbore 114, the proximate fracturing interval 2, 4, or 6, the subterranean formation 102, or combinations thereof or to not communicate fluid. In an embodiment, each MFT 220 may be configurable independent of any other MFT 220 which may be comprised along that same tubing member (e.g., a casing string). Thus, for example, a first MFT 220 may be configured to emit fluid therefrom and into the surrounding wellbore 114 and/or formation 102 while the second MFT 220 or third MFT 220 may be configured to not emit fluid.

Figure 12:
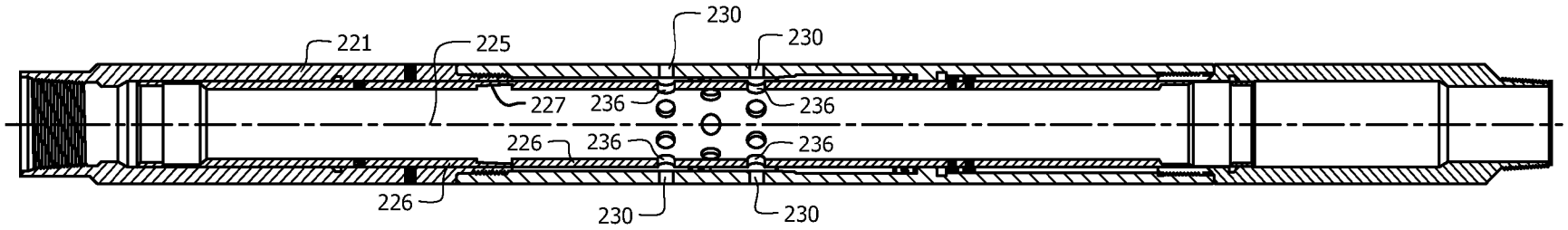
FIG. 12 is a partial cutaway view of a manipulatable fracturing tool.

Referring to FIG. 12, in an embodiment the MFT 220 comprises a body 221. In the embodiment of FIG. 12, the body 221 of the MFT 220 is a generally cylindrical or tubular-like structure. Alternatively, a body of a MFT 220 may comprise any suitable structure or configuration; such suitable structures will be appreciated by those of skill in the art with the aid of this disclosure.

As shown in FIG. 12, in an embodiment the MFT 220 may be configured for incorporation into the casing string 180. In such an embodiment, the body 221 may comprise a suitable connection to the casing string 180 (e.g., to a casing string member). For example, as illustrated in FIG. 12, terminal ends of the body 221 of the MFT 220 comprise one or more internally or externally threaded surfaces suitably employed in making a threaded connection to the casing string 180. Alternatively, a MFT 220 may be incorporated within a casing string 180 via any suitable connection. Suitable connections to a casing member will be known to those of skill in the art.

In an embodiment, the plurality of manipulatable fracturing tools 220 may be separated by one or more lengths of tubing (e.g., casing members). Each MFT 220 may be configured so as to be threadedly coupled to a length of casing or to another MFT 220. Thus, in operation, where multiple manipulatable fracturing tools 220 will be used, an uppermost MFT 220 may be threadedly coupled to the downhole end of the casing string. A length of tubing is threadedly coupled to the downhole end of the upper-most MFT 220 and extends a length to where the downhole end of the length of tubing is threadedly coupled to the upper end of a second upper-most MFT 220. This pattern may continue progressively moving downward for as many MFTs 220 as are desired along the wellbore servicing apparatus 200. As such, the distance between any two manipulatable fracturing tools is adjustable to meet the needs of a particular situation. The length of tubing extending between any two MFTs 220 may be approximately the same as the distance between a fracturing interval to which the first MFT 220 is to be proximate and the fracturing interval to which the second MFT 220 is to be proximate, the same will be true as to any additional MFTs 220 for the servicing of any additional fracturing intervals 2, 4, or 6. Additionally, a length of casing may be threadedly coupled to the lower end of the lower-most MFT and may extend some distance toward the terminal end of the wellbore 114 therefrom. In an alternative embodiment, the MFTs need not be separated by lengths of tubing but may be coupled directly, one to another.

In an embodiment, the tubing lengths may be such that the space between two MFTs may be approximately equal to a fracturing interval spacing as previously determined (e.g., approximately the same as the space between the desired fracturing intervals). For example, in the embodiment of FIG. 11 the space between the first MFT 220 and the second MFT 220 may be approximately the same as the space between a first fracturing interval 2 and a second fracturing interval 4. Likewise, the space between the second MFT 220 and the third MFT 220 may be approximately the same as the space between a second fracturing interval 4 and a third fracturing interval 6. As such, in an embodiment the wellbore servicing apparatus 200 may be configured to introduce two or more fractures into the subterranean formation 102 at a spacing equal to, alternatively, approximately equal to, a determined fracturing interval spacing.

In the embodiment of FIG. 12, the interior surface of the body 221 defines an axial flowbore 225. Referring again to FIG. 11, the MFTs 220 are incorporated within the casing string 180 such that the axial flowbore 225 of the MFT 220 is in fluid communication with the axial flowbore of the casing string 180.

In an embodiment, each MFT 220 comprises one or more apertures or ports 230. The ports 230 of the MFT 220 may be selectively, independently manipulated, (e.g., opened or closed, fully or partially) so as to allow, restrict, curtail, or otherwise control one or more routes of fluid communication between the interior axial flowbore 225 of the MFT 220 and the wellbore 114, the proximate fracturing interval 2, 4, or 6, the subterranean formation 102, or combinations thereof. In an embodiment, because each MFT 220 may be independently configurable, the ports 230 of a given MFT 220 may be open to the surrounding wellbore 114 and/or fracturing interval 2, 4, or 6 while the ports 230 of another MFT 220 comprising the wellbore servicing apparatus 200 are closed.

In the embodiment of FIG. 12, the one or more ports 230 may extend through body 221 of the MFT. In this embodiment, the ports 230 extend radially outward from the axial flowbore 225. As such, the ports 230 may provide a route of fluid communication between the axial flowbore 225 and the wellbore 114 and/or subterranean formation 102 when the MFT 220 is so-configured (e.g., when the ports 230 are unobstructed). Alternatively, the MFT may be configured such that no fluid will be communicated via the ports 230 between the axial flowbore 225 and the wellbore 114 and/or subterranean formation 102 (e.g., when the ports 230 are obstructed).

As shown in FIG. 12, in an embodiment the MFT 220 may comprise a sliding sleeve 226. The sliding sleeve comprises an outer surface which is configured to slidably fit against the inner surface of the body 221. In the embodiment of FIG. 12, the sliding sleeve or a portion thereof may be configured to slidably fit over and thereby obscure the ports 230 of the MFT 220. As shown in FIG. 12, the sliding sleeve 226 may allow, curtail, or disallow fluid passage via the ports 230 dependent upon whether the sliding sleeve 226 or a portion thereof obscures or partially obscures the ports 230. In an embodiment, the sliding sleeve 226 comprises one or more sliding sleeve ports 236. In such an embodiment, when the sliding sleeve ports 236 are aligned with the ports 230, a route of fluid communication may be provided and, as such, fluid may be communicated between the axial flowbore 225 and the wellbore 114 and/or the subterranean formation 102 via the ports 230 and/or the sliding sleeve ports 236. Alternatively, when the sliding sleeve ports 236 are misaligned with the ports 230, a route of fluid communication may be restricted and, as such fluid will not be communicated to the wellbore 114 and/or the subterranean formation 102 via the ports 230 or the sliding sleeve ports.

In an embodiment, manipulating or configuring the MFT 220 to provide, obstruct, or otherwise alter a route or path of fluid movement through and/or emitted from the MFT 220 may comprise moving the sliding sleeve 226 with respect to the body 221 of the MFT 220. For example, the sliding sleeve 226 may be moved with respect to the body 221 so as to align the ports 230 with the sliding sleeve ports 236 and thereby provide a route of fluid communication or the sliding sleeve 226 may be moved with respect to the body 221 so as to misalign the ports 230 with the sliding sleeve ports 236 and thereby restrict a route of fluid communication. Configuring the MFT 220 (e.g., as by sliding the sliding sleeve 226 with respect to the body 221) may be accomplished via several means such as electric, electronic, pneumatic, hydraulic, magnetic, or mechanical means.

Figure 13:
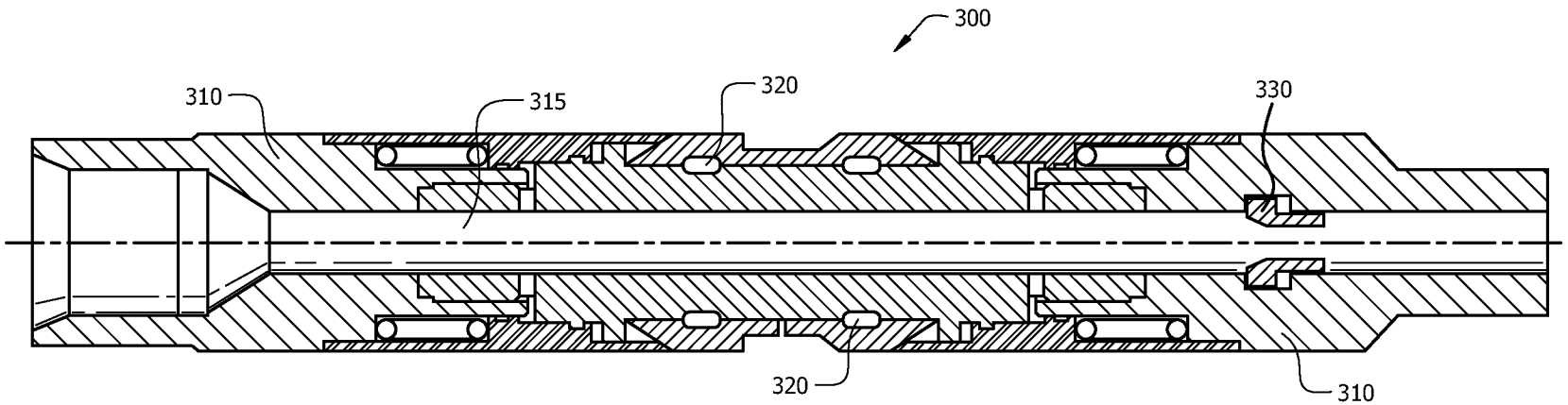
FIG. 13 is a partial cutaway view of a mechanical shifting tool.

In an embodiment, the MFT 220 may be manipulated via a mechanical shifting tool. Referring to FIG. 13, an embodiment of a suitable mechanical shifting tool (MST) 300 is shown. In an embodiment, the MST 300 generally comprises a body 310, extendable member 320, and a seat 330.

Figure 14:
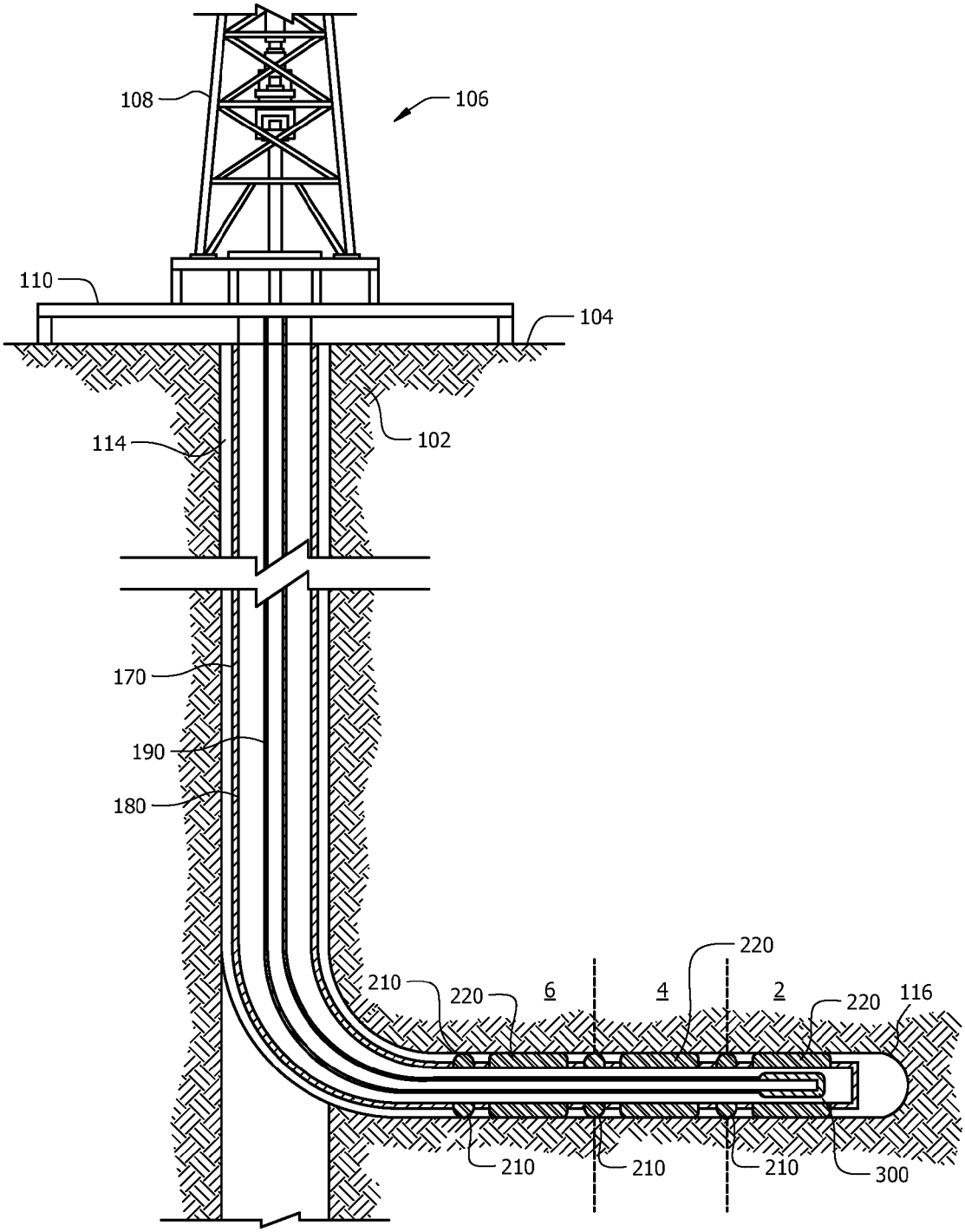
FIG. 14 is a partial cutaway view of a wellbore penetrating a subterranean formation illustrating a mechanical shifting tool incorporated within a tubing string and positioned within a wellbore servicing apparatus.

Referring to FIG. 14, in an embodiment, the MST 300 may be coupled to a tubing string 190 (e.g., coiled tubing) such that the axial flowbore 315 of the MST 300 is in fluid communication with the axial flowbore of the tubing string 190. In an embodiment, the MST coupled to tubing string 190 may be inserted within the casing string 180. In an embodiment, the tubing string 190 may be run into the casing string to such a depth that the MST 300 is positioned within the wellbore servicing apparatus 220 or a portion thereof, alternatively, such that the MST is substantially proximate to a MFT 220.

Referring again to FIG. 13, in an embodiment, the body 310 comprises a suitable connection to a tubing string. For example, the body 310 may comprise one or more internally or externally threaded surfaces such that the MST 300 may be connected to a tubing string (e.g., coiled tubing). In an embodiment, the body 310 substantially defines an interior axial flowbore 315.

In an embodiment, the seat 330 may be configured to engage an obturating member that is introduced into and circulated through the axial flowbore 315. Nonlimiting examples of obturating members include balls, mechanical darts, foam darts, the like, and combinations thereof. Upon engaging the seat 330, such an obturating member may substantially restrict or impede the passage of fluid from one side of the obturating member to the other. In such an embodiment, a pressure differential may develop on at least one side of an obturating member engaging the seat 330.

In an embodiment, the seat 330 may be operably coupled to the extendable member 320. Nonlimiting examples of a suitable extendable member include a lug, a dog, a key, or a catch. As such, when the obturating member is introduced into the axial flowbore 315 of the MST 300 and circulated so as to engage the seat 330, a pressure may build against the obturating member and/or the seat 330, thereby causing the extendable member 320 to extend outwardly.

In an embodiment, the sliding sleeve 226 comprises one or more complementary lugs, dogs, keys, catches 227, the operation of which will be discussed in greater detail herein below. Referring to FIG. 15, in an embodiment, when an obturating member is introduced into tubing string 190 and circulated therethrough so as to engage the seat 330 of the MST 300 and thereby causing the extendable member 320 to be extended, the extendable member 320 may engage the sliding sleeve 226 of a substantially proximate MFT 220. In an embodiment, the extendable member 320 may engage the complementary lugs, dogs, keys, catches 227 of the sliding sleeve 226. Upon engaging the sliding sleeve 226, the MST 300 and the tubing string 190 may be coupled to the sliding sleeve 226. As such, moving the MST 300 and the tubing string 190 may shift the position of the sliding sleeve 226 with respect to the body 221 of the MFT 220. In an embodiment where the MST 300 is coupled to the sliding sleeve 226, the MST 300 and the tubing string 190 may be employed to move the sliding sleeve 226 so as to align the ports 230 and the sliding sleeve ports 236 and thereby provide a route of fluid communication to the wellbore 114 and/or the subterranean formation 102. Alternatively, the MST 300 and the tubing string 190 may be employed to move the sliding sleeve 226 so as to misalign the ports 230 and the sliding sleeve ports 236 and thereby obstruct a route of fluid communication to the wellbore 114 and/or the subterranean formation 102. MFTs and mechanical shifting tools and the operation thereof are discussed in further detail in U.S. application Ser. No. 12/358,079, which is incorporated herein by reference in its entirety.

In an embodiment, the ports 230 may be configured to emit fluid at a pressure sufficient to degrade the proximate fracturing interval 2, 4, or 6. For example, the ports 230 may be fitted with nozzles (e.g., perforating or hydrajetting nozzles). In an embodiment, the nozzles may be erodible such that as fluid is emitted from the nozzles, the nozzles will be eroded away. Thus, as the nozzles are eroded away, the aligned ports 230 and sliding sleeve ports 236 will be operable to deliver a relatively higher volume of fluid and/or at a pressure less than might be necessary for perforating (e.g., as might be desirable in subsequent fracturing operations). In other words, as the nozzle erodes, fluid exiting the ports 230 transitions from perforating and/or initiating fractures in the subterranean formation 120 to expanding and/or propagating fractures in the subterranean formation 102. Erodible nozzles and methods of using the same are disclosed in greater detail in U.S. application Ser. No. 12/274,193 which is incorporated herein in its entirety.

In an embodiment, providing a wellbore servicing apparatus 200 configured to alter the stress anisotropy of the subterranean formation 102 may comprise isolating one or more fracturing intervals 2, 4, or 6 of the subterranean formation 102. In an embodiment, isolating a fracturing interval 2, 4, or 6 may be accomplished via the one or more packers 210. As explained above, when deployed the one or more packers 210 may effectively isolate various portions of the subterranean formation 102 to create two or more fracturing intervals (e.g., by providing a barrier between fracturing intervals 2, 4, or 6). In an embodiment where the packers 210 comprise swellable packers, isolating one or more fracturing intervals may comprise contacting an activation fluid with such swellable packer. In an embodiment where such an activation fluid has been introduced, it may be desirable to remove any portion of the activation fluid remaining, for example as by circulating or reverse circulating a fluid.

In an embodiment, the FCI 1000 suitably comprises altering the stress anisotropy of at least one interval of the subterranean formation 102. In an embodiment, altering the anisotropy of the subterranean formation 102 and/or a fracturing interval thereof generally comprises introducing a first fracture into a first fracturing interval (e.g., first fracturing interval 2) and introducing a second fracture into a third fracturing interval (e.g., third fracturing interval 6), wherein the fracturing interval in which the stress anisotropy is to be altered (e.g., a second fracturing interval 4) is located between the first fracturing interval 2 and the third fracturing interval 6. In an embodiment, the first fracturing interval 2 and the third fracturing interval 6 may be adjacent, substantially adjacent, or otherwise proximate to the fracturing interval in which the stress anisotropy is to be altered.

In an embodiment, introduction of the first fracture within the first fracturing interval 2 and the second fracture within the third fracturing interval 6 may alter the stress anisotropy of the second fracturing interval 4 which is between the first fracturing interval 2 and the third fracturing interval 6.

Figure 15A:
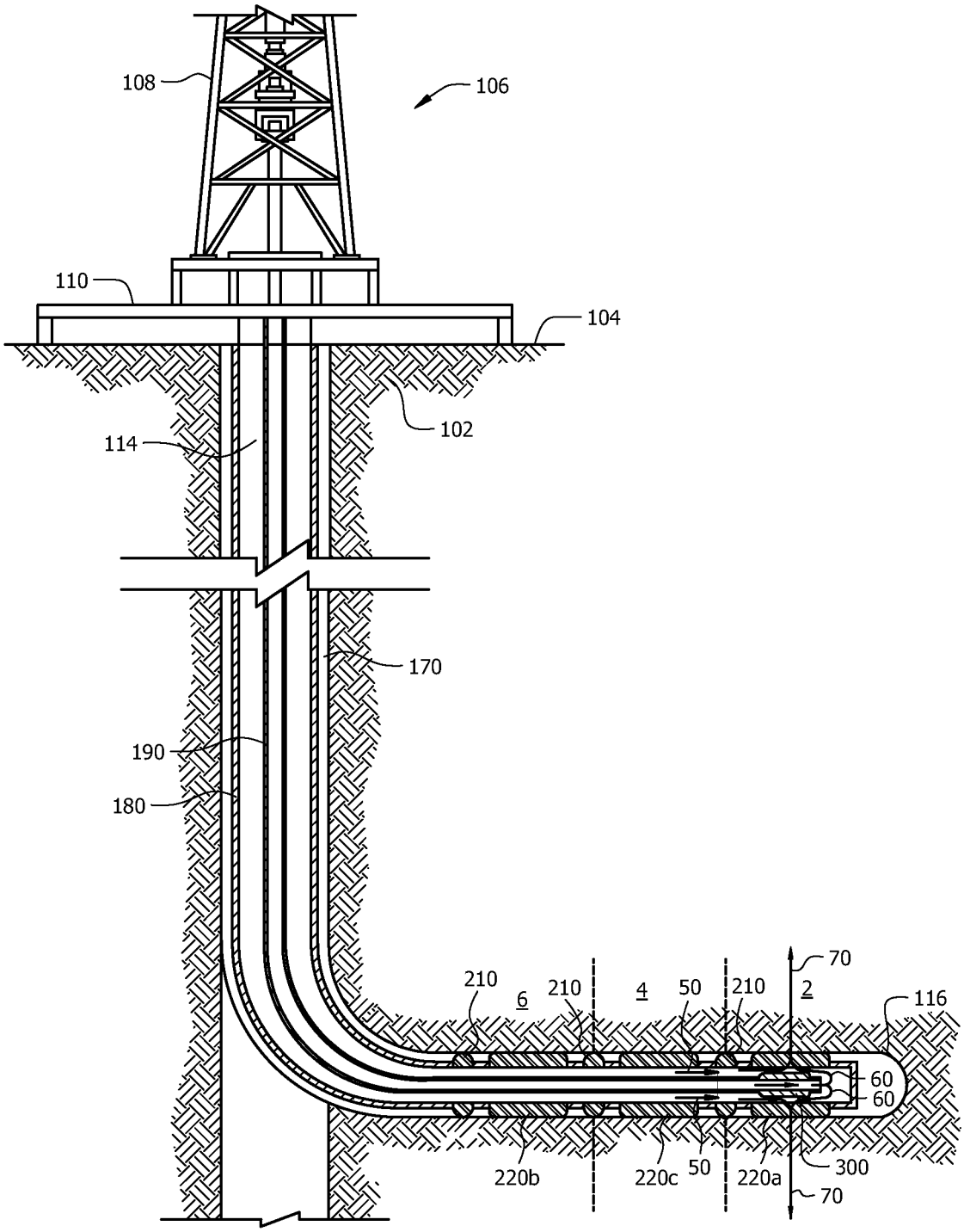
FIG. 15A is a partial cutaway view of a wellbore penetrating a subterranean formation illustrating a fracture being introduced into a first fracturing interval.

In an embodiment, altering the stress anisotropy of at least one interval of the subterranean formation 102 comprises introducing a first fracture into a first fracturing interval. Referring to FIG. 15A, in an embodiment, introducing a first fracture into the first fracturing interval 2 may comprise providing a route of fluid communication to the first fracturing interval 2 via a first MFT 220A, communicating a fluid to the first fracturing interval 2 via the first MFT 220A, and obstructing the route of fluid communication to the first fracturing interval 2 via the first MFT 220A.

In an embodiment, introducing a first fracture into a first fracturing interval 2 comprises providing a route of fluid communication to the first fracturing interval 2 via a first MFT 220A. In an embodiment, providing a route of fluid communication to the first fracturing interval 2 via a first MFT 220A comprises positioning the MST 300 proximate to the first MFT 220A. An obturating member may be introduced into the tubing string 190 and forward circulated therethrough so as to engage the seat 330 of the MST 300. After the obturating member engages the seat 330, continuing to pump fluid may cause the obturating member to exert a force against the seat, thereby actuating the extendable member 320. Actuation of the extendable members may cause the extendable member 320 to engage the sliding sleeve 226 of the first MFT 220A (e.g., via the complementary dogs, keys, or catches) such that the sliding sleeve 226 may be moved with respect to the body 221 of the first MFT 220A and thereby provide a route of fluid communication between the axial flowbore 225 of the first MFT 220A and the first fracturing interval 2 by aligning the ports 230 with the sliding sleeve ports 236 and providing a route of fluid communication therethrough. After the ports 230 have been aligned with the sliding sleeve ports 236, the pressure may be released from the tubing string 190 such that pressure is no longer applied via the seat 330 and thereby allowing the extendable member 320 to disengage the sliding sleeve 226.

In an embodiment, introducing a first fracture into a first fracturing interval 2 comprises communicating a fluid to the first fracturing interval 2 via the first MFT 220A. In an embodiment, communicating a fluid to the first fracturing interval 2 via the first MFT 220A comprises reverse circulating the obturating member such that the obturating member disengages the seat 330, returns through the tubing string 190, and may be removed therefrom. With the obturating member removed, a fluid pumped through the tubing string 190 and the interior flowbore 315 of the MST 300 may be emitted from the lower (e.g., downhole) end of the MST 300. In an embodiment, the MST 300 may be run further into the casing string 180 such that the MST 300 is below (e.g., downhole from) the first MFT 220A.

In an embodiment, fluid may be communicated to the first fracturing interval 2 via a first flowpath, a second flowpath, or combinations thereof. In such an embodiment, a suitable first flowpath may comprise the interior flowbore of the tubing string 190 and the MST 300 (e.g., as shown by flow arrow 60) and a suitable second flowpath may comprise the annular space between the tubing string 190 and the casing string 180, or both (e.g., as shown by flow arrow 50).

In an embodiment, the fluid communicated to a fracturing interval (e.g., 2, 4, or 6) may comprise a compound fluid comprising two or more component fluids. In an embodiment, a first component fluid may be communicated via a first flowpath (e.g., flow arrow 60 or 50) and a second fluid may be communicated via a second flowpath (e.g., flow arrow 50 or 60). The first component fluid and the second component fluid may mix in a downhole portion of the wellbore or the casing string before entering the subterranean formation 102 or a fracturing interval 2, 4, or 6 thereof (e.g., as shown by flow arrow 70).

In such an embodiment, the first component fluid may comprise a concentrated fluid and the second component fluid may comprise a dilute fluid. The first component fluid may be pumped at a rate independent of the second component fluid and, likewise, the second component fluid at a rate independent of the first. As will be appreciated by one of skill in the art, wellbore servicing fluids (e.g., fracturing fluids, hydrajetting fluids, and the like) may tend to erode or abrade wellbore servicing equipment. As such, operators have conventionally been limited as to the rate at which an abrasive fluid may be communicated, for example, operators have conventionally been unable to achieve pumping rates greater than about 35 ft./sec. By mixing two or more component fluids of an abrasive fluid downhole, an operator is able to achieve a higher effective pumping rate (e.g., the rate at which the compound fluid in introduced into the subterranean formation 102). In an embodiment, the concentrated fluid component may be pumped via either the first flowpath or the second flowpath at a rate which will not damage or abrade wellbore servicing equipment while the dilute fluid component may be pumped via the other of the first flowpath or the second flowpath at a higher rate. For example, because the dilute fluid component comprises little or no abrasive material, it may be pumped at a higher rate without risk of damaging (e.g., abrading or eroding) wellbore servicing equipment or component thereof, for example, at a rate greater than about 35 ft./sec. As such, the operator may achieve a higher effective pumping rate of abrasive fluids.

Further, by mixing two or more component fluids of an abrasive fluid downhole, because the component fluids are variable as to the rate at which they are pumped, an operator may manipulate the rates of the first component fluid, the second component fluid, or both, to thereby effectuate changes in the concentration of the compound fluid in real-time. Multiple flowpaths, downhole mixing of multiple component fluids, variable-rate pumping, methods of the same, and related apparatuses are disclosed in greater detail in U.S. application Ser. No. 12/358,079 which is incorporated herein in its entirety.

In an embodiment, the compound fluid may comprise a hydrajetting fluid. In such an embodiment, the concentrated component fluid may comprise a concentrated abrasive fluid (e.g., sand). In such an embodiment, the concentrated abrasive fluid may be pumped via the flowbore of the tubing string 190 and the interior flowbore 315 of the MST 300 (e.g., flow arrow 60) and the diluent (e.g., water) may be pumped via the annular space (e.g., flow arrow 50) to form a hydrajetting fluid (e.g., flow arrow 70). The component fluids of the hydrajetting fluid may be pumped at an effective rate (e.g., communicated to the subterranean formation 102) and/or pressure sufficient to abrade the subterranean formation 102 and/or to initiate the formation of a fracture therein.

In an embodiment, the compound fluid may comprise a fracturing fluid. In such an embodiment, the concentrated component fluid may comprise a concentrated proppant-bearing fluid. In such an embodiment, the concentrated proppant-bearing fluid may be pumped via the flowbore of the tubing string 190 and the interior flowbore 315 of the MST 300 (e.g., flow arrow 60) and the diluent (e.g., water) may be pumped via the annular space (e.g., flow arrow 50) to form a fracturing fluid (e.g., flow arrow 70). The component fluids of the fracturing fluid may be pumped at an effective rate (e.g., communicated to the subterranean formation 102) sufficient to initiate and/or extend a fracture in the first fracturing interval. In an embodiment, the fracturing fluid may enter the subterranean formation 102 cause a fracture to form or extend therein.

In an embodiment, introducing a first fracture into a first fracturing interval 2 comprises obstructing the route of fluid communication to the first fracturing interval 2 via the first MFT 220A. In an embodiment, obstructing the route of fluid communication to the first fracturing interval 2 via the first MFT 220A comprises positioning the MST 300 proximate to the first MFT 220A. An obturating member may again be introduced into the tubing string 190 and forward circulated therethrough so as to engage the seat 330 of the MST 300. After the obturating member engages the seat 330, continuing to pump fluid may cause the obturating member to exert a force against the seat, thereby actuating the extendable members 320. Actuation of the extendable members may cause the extendable members to engage the sliding sleeve of the first MFT 220A such that the sliding sleeve may be moved with respect to the body of the first MFT 220A to obstruct the route of fluid communication between the interior flowbore 225 of the first MFT and the first fracturing interval 2 by misaligning the ports 230 with the sliding sleeve ports 236. After the ports 230 have been misaligned from the sliding sleeve ports 236, the pressure may be released from the tubing string 190 such that pressure is no longer applied via the seat 330 and thereby allowing the extendable member 320 to disengage the sliding sleeve. The MST 300 may be moved to another MFT 200 proximate to another fracturing interval, alternatively, the MST 300 may be removed from the interior of the casing string 180.

Figure 15B:
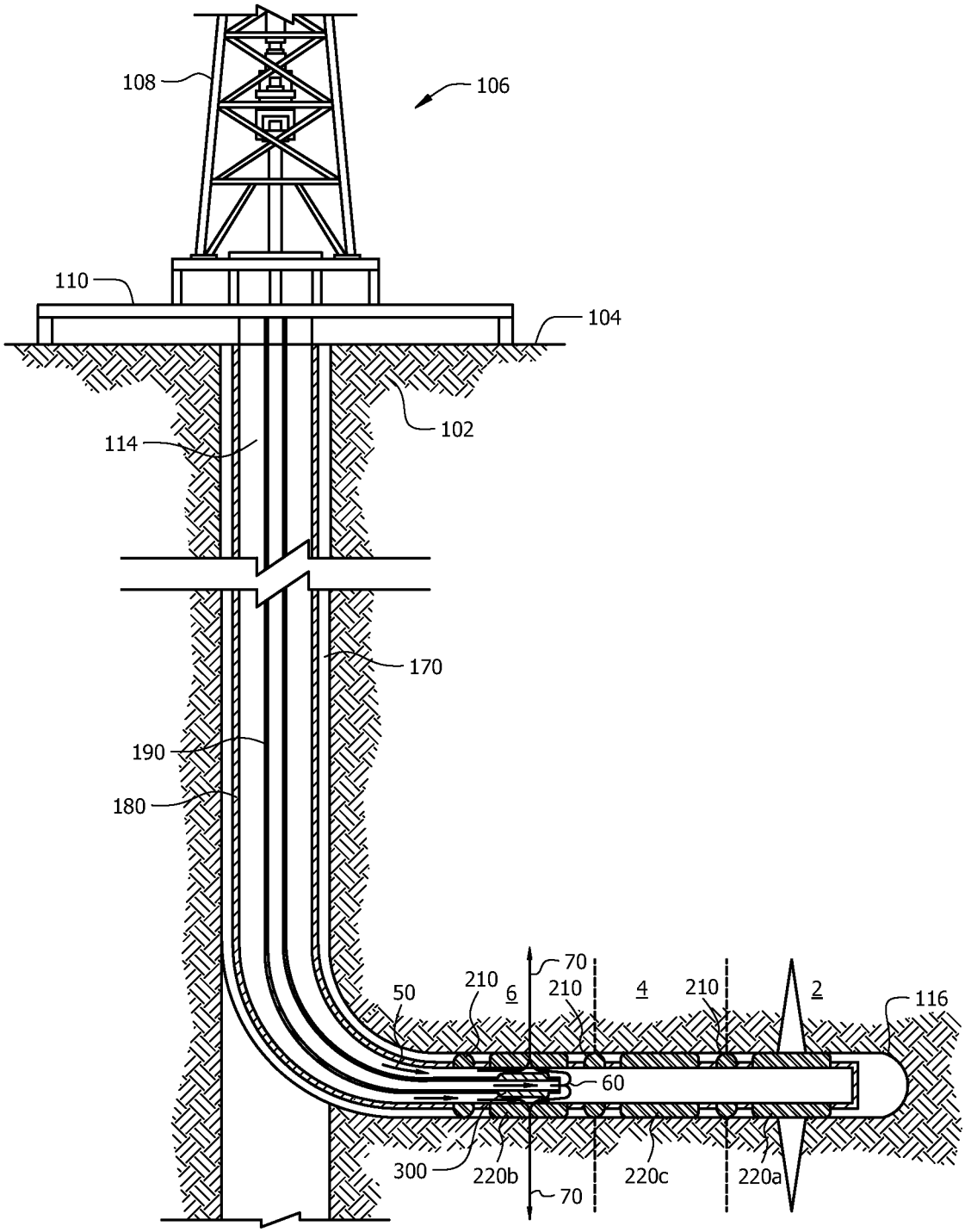
FIG. 15B is a partial cutaway view of a wellbore penetrating a subterranean formation illustrating a fracture being introduced into a second fracturing interval.

In an embodiment, altering the stress anisotropy of at least one interval of the subterranean formation 102 comprises introducing a second fracture into a third fracturing interval 6. Referring to FIG. 15B, in an embodiment, introducing a second fracture into the third fracturing interval 6 may comprise providing a route of fluid communication to the third fracturing interval 6 via a second MFT 220B, communicating a fluid to the third fracturing interval 6 via the second MFT 220B, and obstructing the route of fluid communication the third fracturing interval 6 via the second MFT 220B.

In an embodiment, providing a route of fluid communication to the third fracturing interval 6 via a second MFT 220A comprises positioning the MST 300 proximate to the second MFT 220B. An obturating member may be introduced into the tubing string 190 and forward circulated therethrough so as to engage the seat 330 of the MST 300. After the obturating member engages the seat 330, continuing to pump fluid may cause the obturating member to exert a force against the seat, thereby actuating the extendable members 320. Actuation of the extendable members may cause the extendable members to engage the sliding sleeve 226 of the second MFT 220B (e.g., via the dogs, keys, or catches) such that the sliding sleeve 226 may be moved with respect to the body 221 of the second MFT 220B to provide a route of fluid communication between the interior flowbore 225 of the second MFT 220B and the third fracturing interval 6 by aligning the ports 230 with the sliding sleeve ports 236. After the ports 230 have been aligned with the sliding sleeve ports 236, the pressure may be released from the tubing string 190 such that pressure is no longer applied via the seat 330 and thereby allowing the extendable member 320 to disengage the sliding sleeve.

In an embodiment, introducing a second fracture into the third fracturing interval 6 comprises communicating a fluid to the third fracturing interval 6 via the second MFT 220B. In an embodiment, communicating a fluid to the third fracturing interval 6 via the second MFT 220B comprises reverse circulating the obturating member such that the obturating member disengages the seat 330, returns through the tubing string 190, and may be removed therefrom. With the obturating member removed, a fluid pumped through the tubing string 190 and the interior flowbore 315 of the MST 300 may be emitted from the lower (e.g., downhole) end of the MST 300. In an embodiment, the MST may be run further into the casing string 180 such that the MST 300 is below (e.g., downhole from) the second MFT 220B.

In an embodiment, as explained above with reference to the introduction of a first fracture, fluid may be communicated to the third fracturing interval 6 via a first flowpath, a second flowpath, or combinations thereof (e.g., as shown by flow arrows 50 and/or 60). In such an embodiment, a suitable first flowpath may comprise the interior flowbore of the tubing string 190 and the MST 300 (e.g., flow arrow 60) and a suitable second flowpath may comprise the annular space between the tubing string 190 and the casing string 180, or both (e.g., flow arrow 50). In an embodiment, the fluid communicated to the third fracturing interval 6 may comprise two or more component fluids.

In an embodiment, the fluid may comprise a hydrajetting fluid which may be pumped at an effective rate (e.g., communicated to the subterranean formation 102) and/or pressure sufficient to abrade the subterranean formation 102 and/or to initiate the formation of a fracture. In another embodiment, the fluid may comprise a fracturing fluid which may be pumped at an effective rate (e.g., communicated to the subterranean formation 102) sufficient to initiate and/or extend a fracture in the first fracturing interval. In another embodiment, the fracturing fluid may enter cause a fracture to form or extend within the subterranean formation 102.

In an embodiment, introducing a second fracture into the third fracturing interval 6 comprises obstructing the route of fluid communication to the second fracturing interval 6 via the second MFT 220B. In an embodiment, obstructing the route of fluid communication the second fracturing interval 6 via the second MFT 220B comprises positioning the MST 300 proximate to the second MFT 220B. An obturating member may again be introduced into the tubing string 190 and forward circulated therethrough so as to engage the seat 330 of the MST 300. After the obturating member engages the seat 330, continuing to pump fluid may cause the obturating member to exert a force against the seat, thereby actuating the extendable members 320. Actuation of the extendable members may cause the extendable members to engage the sliding sleeve (e.g., via the complementary dogs, keys, or catches) of the second MFT 220B such that the sliding sleeve 226 may be moved with respect to the body 221 of the second MFT 220B to obstruct a route of fluid communication between the interior flowbore 225 of the second MFT 220B and the third fracturing interval 6 by misaligning the ports 230 with the sliding sleeve ports 236. After the ports 230 have been misaligned from the sliding sleeve ports 236, the pressure may be released from the tubing string 190 such that pressure is no longer applied via the seat 330 and thereby allowing the extendable member 320 to disengage the sliding sleeve 226.

Figure 15C:
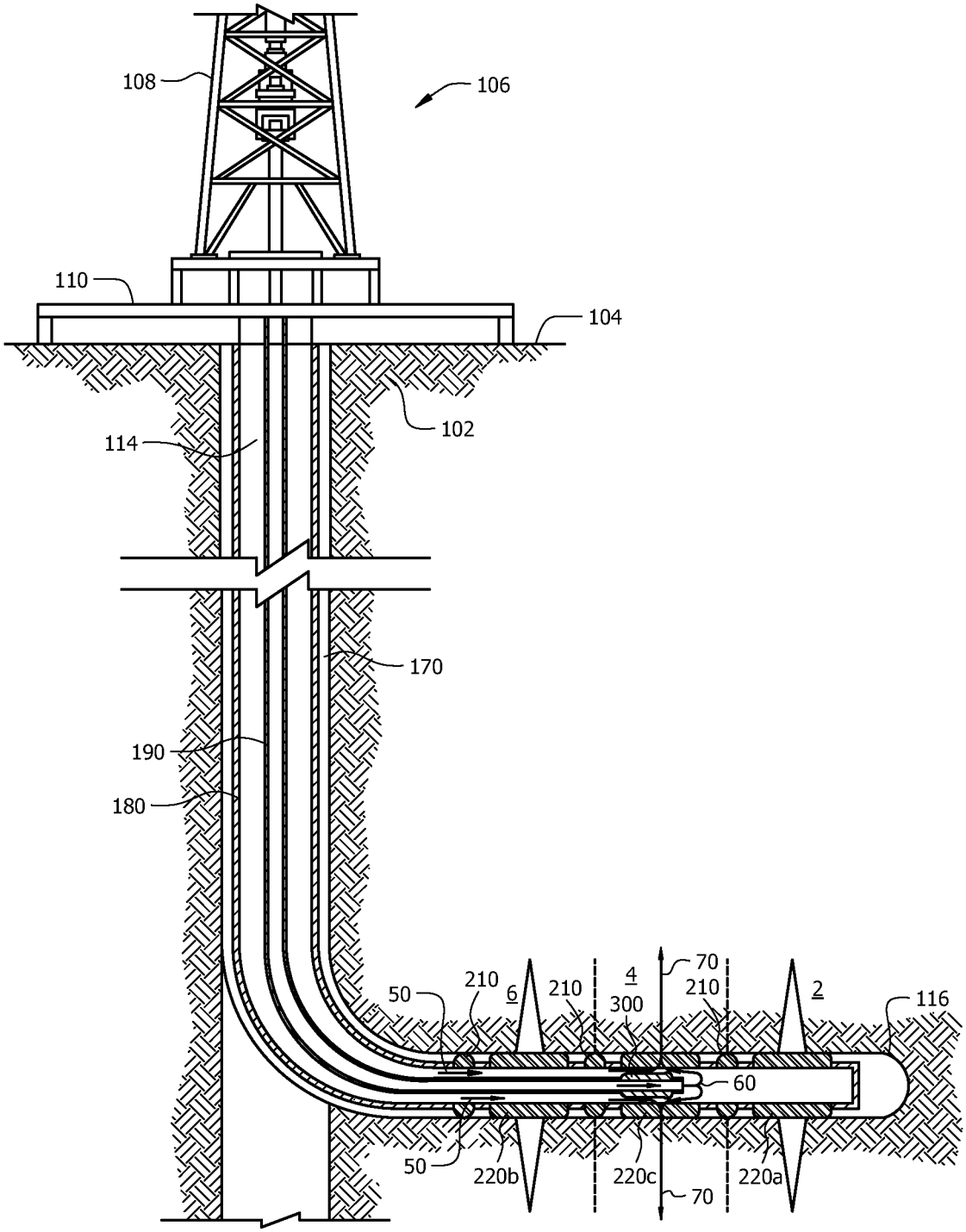
FIG. 15C is a partial cutaway view of a wellbore penetrating a subterranean formation illustrating a fracture being introduced into a third fracturing interval between the first fracturing interval and the second fracturing interval.

In an embodiment, the introduction of a fracture within the first fracturing interval 2 and the introduction of a fracture within the third fracturing interval 6 may alter the anisotropy of the second fracturing interval 4. Referring to FIGS. 15A, 15B, and 15C, the second fracturing interval 4 may be located along the deviated wellbore portion 116 between the first fracturing interval 2 and the third fracturing interval 6. Not seeking to be bound by theory, the fractures introduced into the first fracturing interval 2 and the third fracturing interval 6 may cause an increase in the magnitude of $\sigma_{HMax}$ and $\sigma_{HMin}$ in the second fracturing interval 4. As explained herein, the increase in the magnitude of $\sigma_{HMin}$ may be greater than the increase in the magnitude of $\sigma_{HMax}$. As such, the stress anisotropy within the second fracturing interval 4 may decrease. In an embodiment, introduction of a fracture or fractures at a certain net fracture extension pressure (e.g., the net fracture extension pressure previously determined) and at a certain spacing (e.g., the fracturing interval spacing previously determined), may alter the stress anisotropy within the subterranean formation 102 and/or a fracturing interval thereof in a predictable way. In an embodiment, introduction of a fracture or fractures into adjacent fracturing intervals may reduce, equalize, or reverse the stress anisotropy within an intervening fracturing interval.

In an embodiment, the FCI 1000 suitably comprises introducing a fracture into the fracturing interval in which the stress anisotropy has been altered. Not to be bound by theory, as disclosed herein the reduction, equalization, or reversal of the stress anisotropy of a fracturing interval and/or a portion of the subterranean formation 102 may encourage the formation of a branched fractures thereby leading to the creation of at least one complex fracture network therein. Not to be bound by theory, because the fracture may not be restricted to opening along only a single axis, by altering the stress field within a fracturing interval may allow a fracture introduced therein to develop branched fractures and fracture complexity.

Referring to FIG. 15C, in an embodiment, introducing a fracture into the second fracturing interval 4 in which the stress anisotropy has been altered may comprise providing a route of fluid communication to the second fracturing interval 4 via a third MFT 220C, communicating a fluid to the second fracturing interval 4 via the third MFT 220C, and obstructing the route of fluid communication to the second fracturing interval 4 via the third MFT 220C.

In an embodiment, introducing a fracture into the second fracturing interval 4 in which the stress anisotropy has been altered may comprise providing a route of fluid communication to the second fracturing interval 4 via a third MFT 220C. In an embodiment, providing a route of fluid communication to the second fracturing interval 4 via a third MFT 220C comprises positioning the MST 300 proximate to the third MFT 220C. An obturating member may be introduced into the tubing string 190 and forward circulated therethrough so as to engage the seat 330 of the MST 300. After the obturating member engages the seat 330, continuing to pump fluid may cause the obturating member to exert a force against the seat, thereby actuating the extendable members 320. Actuation of the extendable members may cause the extendable members to engage the sliding sleeve 226 of the third MFT 220C such that the sliding sleeve 226 may be moved with respect to the body 221 of the third MFT 220C to provide a route of fluid communication between the interior flowbore 225 of the third MFT 220C and the third fracturing interval 4 by aligning the ports 230 with the sliding sleeve ports 236. After the ports 230 have been aligned with the sliding sleeve ports 236, the pressure may be released from the tubing string 190 such that pressure is no longer applied via the seat 330 and thereby allowing the extendable member 320 to disengage the sliding sleeve.

In an embodiment, introducing a fracture into the second fracturing interval 4 in which the stress anisotropy has been altered may comprise communicating a fluid to the second fracturing interval 4 via the third MFT 220C. In an embodiment, communicating a fluid through the third MFT 220C comprises reverse circulating the obturating member such that the obturating member disengages the seat 330, returns through the tubing string 190, and may be removed therefrom. With the obturating member removed, a fluid pumped through the tubing string 190 and the interior flowbore 315 of the MST 300 may be emitted from the end of the MST 300. In an embodiment, the MST may be run further into the casing string 180 such that the MST 300 is below (e.g., downhole from) the third MFT 220C.

In an embodiment, as explained above with reference to the introduction of the first and second fractures, fluid may be communicated to the second fracturing interval 4 via a first flowpath, a second flowpath, or combinations thereof (e.g., as shown by flow arrows 50 and/or 60). In such an embodiment, a suitable first flowpath may comprise the interior flowbore of the tubing string 190 and the MST 300 (e.g., flow arrow 60) and a suitable second flowpath may comprise the annular space between the tubing string 190 and the casing string 180 (e.g., flow arrow 50), or both. In an embodiment, the fluid communicated to the third fracturing interval 6 may comprise two or more component fluids.

In an embodiment, the fluid may comprise a hydrajetting fluid which may be pumped at an effective rate (e.g., communicated to the subterranean formation 102) and/or pressure sufficient to abrade the subterranean formation 102 and/or to initiate the formation of a fracture. In another embodiment, the fluid may comprise a fracturing fluid which may be pumped at an effective rate (e.g., communicated to the subterranean formation 102) sufficient to initiate and/or extend a fracture in the first fracturing interval. In an embodiment, the fracturing fluid may enter the subterranean formation 102 and cause a branched and/or complex fracture network to form or extend therein.

In an embodiment, an operator may vary the complexity of a fracture introduced into a subterranean formation. For example, by varying the rate at which fluid in injected, pumping low concentrations of small particulates, employing a viscous gel slug, or combinations thereof, an operator may impede excessive complexity from forming. Alternatively, for example, by varying injection rates, pumping high concentrations of larger particulates, employing a low-viscosity slick water, or combinations thereof, an operator may induce fracture complexity to form. The use of Micro-Seismic fracture mapping to determine the effectiveness of fracture branching treatment measures in real-time is discussed in Cipolla, C. L., et al., "The Relationship Between Fracture Complexity, Reservoir Properties, and Fracture Treatment Design," SPE115769, 2008 SPE Annual Technical Conference and Exhibition in Denver, Colo., which is incorporated herein by reference in its entirety. Process Zone Stress (PZS) resulting from fracture complexity in coals and recommendations to remediate excessive PZS is discussed in Muthukumarappan Ramurthy et al., "Effects of High-Pressure-Dependent Leakoff and High-Process-Zone Stress in Coal Stimulation Treatments," SPE107971, 2007 SPE Rocky Mountain Oil & Gas Technology Symposium in Denver, Colo., which is incorporated herein by reference in its entirety.

In an embodiment, introducing a fracture into the second fracturing interval 4 in which the stress anisotropy has been altered may comprise obstructing the route of fluid communication to the second fracturing interval 4 via the third MFT 220C. In an embodiment, obstructing the route of fluid communication to the second fracturing interval 4 via the third MFT 220C comprises positioning the MST 300 proximate to the third MFT 220C. An obturating member may again be introduced into the tubing string 190 and forward circulated therethrough so as to engage the seat 330 of the MST 300. After the obturating member engages the seat 330, continuing to pump fluid may cause the obturating member to exert a force against the seat, thereby actuating the extendable members 320. Actuation of the extendable members may cause the extendable members to engage the sliding sleeve of the third MFT 220C such that the sliding sleeve may be moved with respect to the body of the third MFT 220C to obstruct a route of fluid communication between the interior flowbore 225 of the third MFT 220C and the second fracturing interval 4 by misaligning the ports 230 with the sliding sleeve ports 236. After the ports 230 have been misaligned from the sliding sleeve ports 236, the pressure may be released from the tubing string 190 such that pressure is no longer applied via the seat 330 and thereby allowing the extendable member 320 to disengage the sliding sleeve.

Figure 16:
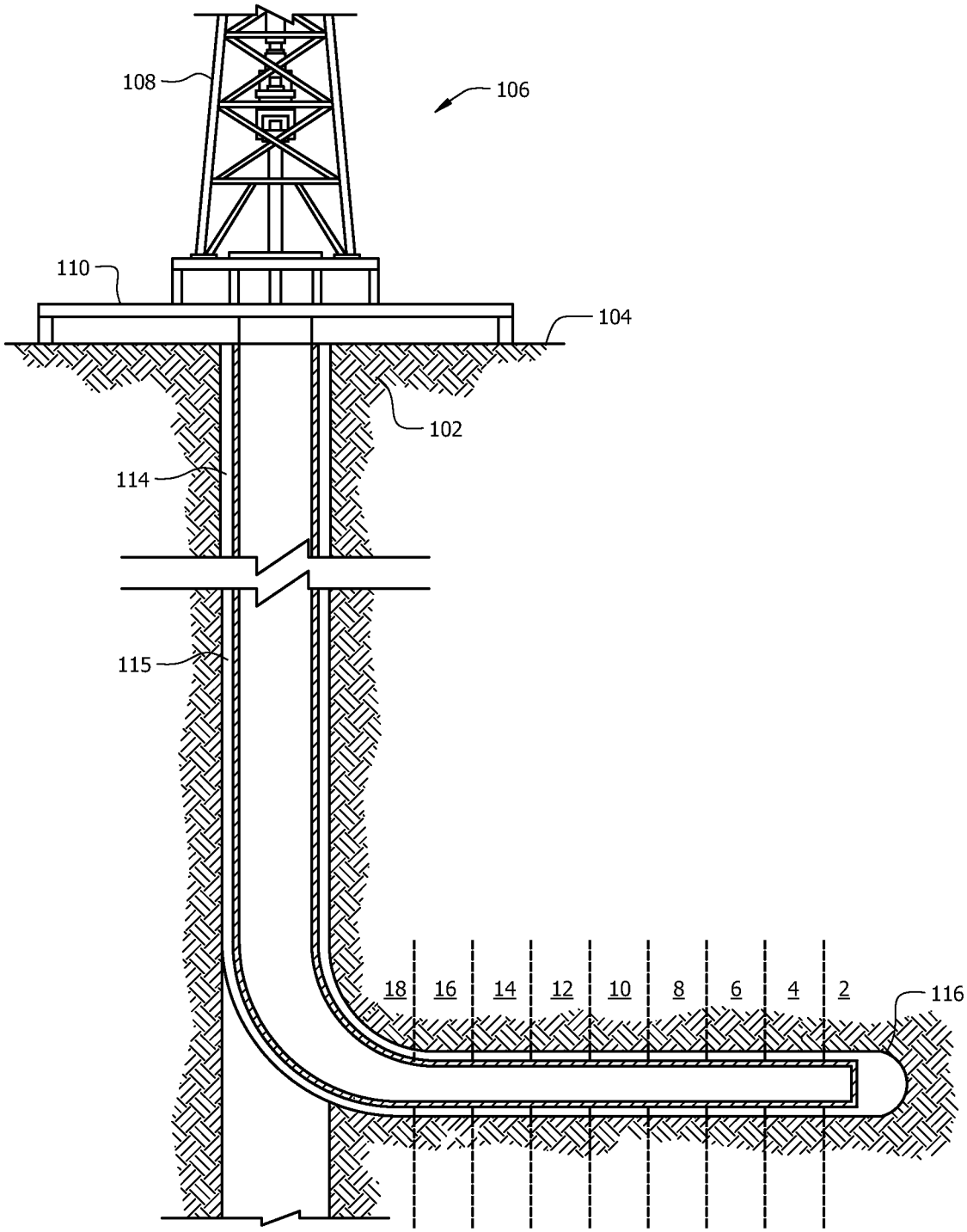
FIG. 16 is a partial cutaway view of a wellbore penetrating a subterranean formation illustrating multiple fracturing intervals along a deviated portion of a wellbore.

Referring to FIG. 16, in an additional embodiment, a fracture complexity inducing method may suitably comprise altering the stress anisotropy in a fourth fracturing interval 8, for example, as by introducing a one or more fractures into two or more fracturing intervals proximate, adjacent, and/or about or substantially adjacent thereto (e.g., the third fracturing interval 6 and a fifth fracturing interval 10) so as to predictably alter the stress anisotropy therein. Such a method may comprise introducing a fracture into the fourth fracturing interval 8 after the stress anisotropy therein has been predictably altered (e.g., reduced, equalized, or reversed). One of skill in the art with the aid of this disclosure will readily understand how the methods, systems, and apparatuses disclosed herein might be employed so as to introduce fracture complexity into additional fracturing intervals.

Referring again to FIG. 16, in an embodiment, a fracture-complexity inducing method generally comprises introducing at least one fracture into a fracturing interval in which the stress anisotropy has been altered by introducing at least one fracture into at least one, alternatively both, of the fracturing intervals adjacent thereto. In an embodiment, a fracture may be introduced into fracturing intervals in any suitable sequence. A suitable sequence for the introduction of fractures may be any sequence which allows for the stress anisotropy of a fracturing interval in which it is desired to introduce fracture complexity to be altered (e.g., as by the introduction of a fracture into the adjacent fracturing intervals) prior to the introduction of a fracture therein. Referring to FIG. 16, non-limiting examples of suitable sequences in which fractures may be introduced into the various fracturing intervals include 2-6-4-10-8-14-12-18-16; 2-6-10-14-18-4-8-12-16; 2-6-10-14-18-16-12-8-4; 18-14-16-10-12-6-8-2-4; 18-14-10-6-2-4-8-12-16; 18-14-10-6-2-16-12-8-4; or portions or combinations thereof. Alternative suitable sequences in which fractures may be introduced into the various fracturing intervals will be recognizable to one of skill in the art with the aid of this disclosure.

In an embodiment, one or more of the methods disclosed herein may further comprise providing a route a fluid communication into the casing so as to allow for the production of hydrocarbons from the subterranean formation to the surface. In an embodiment, providing a route of fluid communication may comprise configuring one or more MFTs to provide a route of fluid communication as disclosed herein above. In an embodiment, an MFT may comprise an inflow control assembly. Inflow control apparatuses and methods of using the same are disclosed in detail in U.S. application Ser. No. 12/166,257 which is incorporated herein in its entirety.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

What is claimed is:

1. A method of inducing fracture complexity within a second fracturing interval between a first fracturing interval and a third fracturing interval of a subterranean formation, the method comprising:

defining a horizontal stress anisotropy-altering dimension, wherein the horizontal stress anisotropy-altering dimension comprises a spacing between two or more fracturing intervals, a net fracture extension pressure, a wellbore orientation, or combinations thereof;

positioning a wellbore servicing apparatus configured to alter the horizontal stress anisotropy of the second fracturing interval of the subterranean formation within a wellbore penetrating the subterranean formation;

altering the stress anisotropy in accordance with the horizontal stress anisotropy-altering dimension within the second fracturing interval by decreasing the horizontal stress anisotropy within the second fracturing interval, reversing the orientation of the stress anisotropy within the second fracturing interval, or both, wherein altering the horizontal stress anisotropy comprises introducing a fracture into the first fracturing interval and introducing a fracture into the third fracturing interval, wherein introducing the fracture into the first fracturing interval comprises:

providing a first route of fluid communication from the wellbore to the first fracturing interval, communicating a fluid to the first fracturing interval via the first route of fluid communication, and obstructing the first route of fluid communication, and wherein introducing the fracture into the third fracturing interval comprises:

providing a third route of fluid communication from the wellbore to the third fracturing interval;

communicating a fluid to the third fracturing interval via the third route of fluid communication; and obstructing the third route of fluid communication; and after the horizontal stress anisotropy of the second zone has been altered, introducing a fracture into the second fracturing interval.

2. The method of claim 1, further comprising characterizing the subterranean formation.

3. The method of claim 2, wherein characterizing the subterranean formation comprises determining the horizontal stress anisotropy of the subterranean formation.

4. The method of claim 2, wherein characterizing the subterranean formation comprises determining at least one mechanical property of the subterranean formation.

5. The method of claim 2, wherein characterizing the subterranean formation comprises determining the presence, absence, or degree of naturally-occurring fractures within the subterranean formation.

6. The method of claim 1, wherein the horizontal stress anisotropy-altering dimension is defined by graphical analysis.

7. The method of claim 1, wherein the horizontal stress anisotropy-altering dimension is defined by a mathematical calculation.

8. The method of claim 1, wherein the first fracturing interval and the third fracturing interval are both adjacent to the second fracturing interval in which the horizontal stress anisotropy is to be altered.

9. The method of claim 1, wherein the spacing between the first fracturing interval and the third fracturing interval is approximately equal to the defined horizontal stress anisotropy-altering dimension.

10. A method of servicing a subterranean formation comprising:

introducing a fracture into a first fracturing interval, wherein introducing the fracture into the first fracturing interval comprises:

providing a first route of fluid communication from the wellbore to the first fracturing interval;

communicating a fluid to the first fracturing interval via the first route of fluid communication; and obstructing the first route of fluid communication; and introducing a fracture into a third fracturing interval, where introducing the fracture into the third fracturing interval comprises:

providing a third route of fluid communication from the wellbore to the third fracturing interval;

communicating a fluid to the third fracturing interval via the third route of fluid communication; and obstructing the third route of fluid communication, wherein the fracture introduced into the first fracturing interval, the fracture introduced into the third fracturing interval, or both, are introduced in accordance with a predefined horizontal stress anisotropy-altering dimension, wherein the horizontal stress anisotropy altering dimension comprises a spacing between two or more fracturing intervals, a net fracture extension pressure, a wellbore orientation, or combinations thereof, wherein the first fracturing interval and the third fracturing interval are substantially adjacent to a second fracturing interval, and wherein introducing the fracture into the first fracturing interval and introducing the fracture into the third fracturing interval alters the horizontal stress anisotropy of the second fracturing interval by decreasing the horizontal stress anisotropy within the second fracturing interval, reversing the orientation of the stress anisotropy within the second fracturing interval, or both.

11. The method of claim 10, wherein the spacing between the first fracturing interval and the third fracturing interval is approximately equal to a horizontal stress anisotropy-altering dimension defined so as to predictably alter the horizontal stress anisotropy in the second fracturing interval.

12. The method of claim 10, wherein the spacing between the first fracturing interval and the third fracturing interval is approximately equal to a horizontal stress anisotropy-altering dimension determined so as to minimize or eliminate the horizontal stress anisotropy in the second fracturing interval.

13. The method of claim 10, further comprising introducing a fracture into the second fracturing interval in which the horizontal stress anisotropy has been altered.

14. The method of claim 13, wherein the fracture introduced into the second fracturing interval having the altered horizontal stress anisotropy comprises a branched fracture.

15. A method of servicing a wellbore comprising:

introducing a fracture into a first fracturing interval, wherein introducing the fracture into the first fracturing interval comprises:

providing a first route of fluid communication from the wellbore to the first fracturing interval;

communicating a fluid to the first fracturing interval via the first route of fluid communication; and obstructing the first route of fluid communication;

introducing a fracture into a third fracturing interval, wherein introducing the fracture into the third fracturing interval comprises:

providing a third route of fluid communication from the wellbore to the third fracturing interval;

communicating a fluid to the third fracturing interval via the third route of fluid communication; and obstructing the third route of fluid communication; and after introducing the fracture into the first fracturing interval and introducing the fracture into the third fracturing interval, introducing a fracture into a second fracturing interval, wherein the fracture introduced into the first fracturing interval, the fracture introduced into the third fracturing interval, or both, are introduced in accordance with a predefined horizontal stress anisotropy-altering dimension, wherein the horizontal stress anisotropy-altering dimension comprises a spacing between two ore more fracturing intervals, a net fracture extension pressure, a wellbore orientation, or combinations thereof, wherein the second fracturing interval is between the first fracturing interval and the third fracturing interval, and wherein introducing the fracture into the first fracturing interval and introducing the fracture into the third fracturing interval alters the horizontal stress anisotropy of the second fracturing interval by decreasing the horizontal stress anisotropy within the second fracturing interval, reversing the orientation of the stress anisotropy within the second fracturing interval, and both.

16. The method of claim 15, wherein the fracture introduced into the second fracturing interval is a complex fracture, a branched fracture, or combinations thereof.

17. The method of claim 15, further comprising:

introducing a fracture into a fifth fracturing interval; and introducing a fracture into a fourth fracturing interval, wherein the fourth fracturing interval is between the third fracturing interval and the fifth fracturing interval, wherein introducing the fracture into the third fracturing interval and introducing the fracture into the fifth fracturing interval alters the horizontal stress anisotropy of the fourth fracturing interval, and wherein the fracture introduced into the fourth fracturing interval is introduced after the fractures are introduced into the third fracturing interval and the fifth fracturing interval.

18. The method of claim 17, further comprising:

introducing a fracture into a seventh fracturing interval; and introducing a fracture into a sixth fracturing interval, wherein the sixth fracturing interval is between the fifth fracturing interval and the seventh fracturing interval, and wherein introducing the fracture into the fifth fracturing interval and introducing the fracture into the seventh fracturing interval alters the horizontal stress anisotropy of the sixth fracturing interval, and wherein the fracture introduced into the sixth fracturing interval is introduced after the fractures are introduced into the fifth fracturing interval and the seventh fracturing interval.

19. The method of claim 18, wherein the fractures are introduced into the fracturing intervals in the following order:

the first fracturing interval,
the third fracturing interval,
the second fracturing interval,
the fifth fracturing interval,
the fourth fracturing interval,
the seventh fracturing interval, and
the sixth fracturing interval.

20. The method of claim 18, wherein the fractures are introduced into the fracturing intervals in the following order:

the first fracturing interval,
the third fracturing interval,
the fifth fracturing interval,
the seventh fracturing interval,
the second fracturing interval,
the fourth fracturing interval, and
the sixth fracturing interval.

21. The method of claim 18, wherein the fractures are introduced into the fracturing intervals in the following order:

the first fracturing interval,
the third fracturing interval,
the fifth fracturing interval,
the seventh fracturing interval,
the sixth fracturing interval,
the fourth fracturing interval, and
the second fracturing interval.

22. The method of claim 18, wherein the fractures are introduced into the fracturing intervals in the following order:

the seventh fracturing interval,
the fifth fracturing interval,
the sixth fracturing interval,
the third fracturing interval,
the fourth fracturing interval,
the first fracturing interval, and
the second fracturing interval.

23. The method of claim 18, wherein the fractures are introduced into the fracturing intervals in the following order:

the seventh fracturing interval,
the fifth fracturing interval,
the third fracturing interval,
the first fracturing interval,
the second fracturing interval,
the fourth fracturing interval, and
the sixth fracturing interval.

24. The method of claim 18, wherein the fractures are introduced into the fracturing intervals in the following order:

the seventh fracturing interval,
the fifth fracturing interval,
the third fracturing interval,
the first fracturing interval,
the sixth fracturing interval,
the fourth fracturing interval, and
the second fracturing interval.

25. The method of claim 1, wherein decreasing the horizontal stress anisotropy within the fracturing interval comprises decreasing the difference in magnitude between a maximum horizontal stress and a minimum horizontal stress.

26. The method of claim 1, wherein reversing the orientation of the stress anisotropy within the fracturing interval comprises causing (a) a horizontal stress magnitude in an orientation substantially parallel to a minimum horizontal stress prior to altering the horizontal stress anisotropy to exceed (b) a horizontal stress magnitude in an orientation substantially parallel to a maximum horizontal stress prior to altering the horizontal stress anisotropy.

27. The method of claim 10, wherein decreasing the horizontal stress anisotropy within the second fracturing interval comprises decreasing the difference in magnitude between a maximum horizontal stress and a minimum horizontal stress.

28. The method of claim 10, wherein reversing the orientation of the stress anisotropy within the second fracturing interval comprises causing (a) a horizontal stress magnitude in an orientation substantially parallel to a minimum horizontal stress prior to altering the horizontal stress anisotropy to exceed (b) a horizontal stress magnitude in an orientation substantially parallel to a maximum horizontal stress prior to altering the horizontal stress anisotropy.

29. The method of claim 15, wherein decreasing the horizontal stress anisotropy within the second fracturing interval comprises decreasing the difference in magnitude between a maximum horizontal stress and a minimum horizontal stress.

30. The method of claim 15, wherein reversing the orientation of the stress anisotropy within the second fracturing interval comprises causing (a) a horizontal stress magnitude in an orientation substantially parallel to a minimum horizontal stress prior to altering the horizontal stress anisotropy to exceed (b) a horizontal stress magnitude in an orientation substantially parallel to a maximum horizontal stress prior to altering the horizontal stress anisotropy.

31. The method of claim 1, wherein the fracture is introduced into the first fracturing interval substantially simultaneously with the fracture introduced into the third fracturing interval.

32. The method of claim 1, wherein the fracture is introduced into the first fracturing interval non-simultaneously with the fracture introduced into the third fracturing interval.

* * * * *

UNITED STATES PATENT AND TRADEMARK OFFICE

CERTIFICATE OF CORRECTION

PATENT NO. : 8,439,116 B2
APPLICATION NO. : 12/566467
DATED : May 14, 2013
INVENTOR(S) : Loyd E. East, Jr. et al.

It is certified that error appears in the above-identified patent and that said Letters Patent is hereby corrected as shown below:

In the Specification

Column 9, line 16, replace "σHMin, the σHMin" with --σHMin, the σHMax--.

Signed and Sealed this
Fourth Day of February, 2014

Michelle K. Lee

Michelle K. Lee
*Deputy Director of the United States Patent and Trademark Office*